US010962249B2

(12) United States Patent
Kohashi et al.

(10) Patent No.: US 10,962,249 B2
(45) Date of Patent: Mar. 30, 2021

(54) AIR CONDITIONING APPARATUS AND AIR CONDITIONING CONTROL METHOD

(71) Applicant: PANASONIC INTELLECTUAL PROPERTY MANAGEMENT CO., LTD., Osaka (JP)

(72) Inventors: Yasuo Kohashi, Osaka (JP); Hiroko Sugimoto, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 84 days.

(21) Appl. No.: 16/354,765

(22) Filed: Mar. 15, 2019

(65) Prior Publication Data

US 2019/0293311 A1 Sep. 26, 2019

(30) Foreign Application Priority Data

Mar. 20, 2018 (JP) ..... JP2018-052331
Mar. 20, 2018 (JP) ..... JP2018-052332
Nov. 7, 2018 (JP) ..... JP2018-209779

(51) Int. Cl.
*F24F 11/30* (2018.01)
*F24F 11/74* (2018.01)
(Continued)

(52) U.S. Cl.
CPC ..... *F24F 11/30* (2018.01); *F24F 11/0008* (2013.01); *F24F 11/63* (2018.01); *F24F 11/74* (2018.01)

(58) Field of Classification Search
CPC ..... F24F 11/30; F24F 11/74; F24F 11/0008; F24F 11/63; F24F 3/14; F24F 2003/1446; F24F 11/65; F24F 2110/20; F24F 2110/10
See application file for complete search history.

(56) References Cited

U.S. PATENT DOCUMENTS

2012/0305661 A1* 12/2012 Malchiondo ..... F24F 11/74 236/44 A
2016/0018124 A1* 1/2016 Yamamoto ..... F24F 11/70 700/276

FOREIGN PATENT DOCUMENTS

EP 1 010 952 6/2000
JP 3011708 12/1999
(Continued)

*Primary Examiner* — Mohammad Ali
*Assistant Examiner* — Sheela Rao
(74) *Attorney, Agent, or Firm* — Greenblum & Bernstein, P.L.C.

(57) ABSTRACT

An air conditioning apparatus includes: an absolute humidity set value calculation section that acquires a first absolute humidity determined from a first temperature and a first relative humidity, the first temperature and the first relative humidity being previously set; a dew-point temperature calculation section that acquires a dew-point temperature determined from the first temperature and the first relative humidity; an absolute humidity calculation section that acquires a second absolute humidity determined from a second temperature indicating a temperature inside the room and a second relative humidity indicating a relative humidity inside the room; and a heat exchanger temperature comparison and determination section and an indoor unit fan/blow-off port control section that control a dehumidification operation that stops air-blowing of an indoor unit fan, closes an blow-off port, and cools an indoor heat exchanger at the dew-point temperature when the second absolute humidity is higher than the first absolute humidity.

11 Claims, 12 Drawing Sheets

(51) Int. Cl.
*F24F 11/00* (2018.01)
*F24F 11/63* (2018.01)

(56) References Cited

FOREIGN PATENT DOCUMENTS

| | | |
|---|---|---|
| JP | 2001-280668 | 10/2001 |
| JP | 3446792 | 9/2003 |
| JP | 3999608 | 10/2007 |

* cited by examiner

FIG.3

| ROOM TEMPERATURE [°C] | ABSOLUTE HUMIDITY [g/m³] WITH RESPECT TO ROOM TEMPERATURE AND RELATIVE HUMIDITY | | | | | | |
|---|---|---|---|---|---|---|---|
| | 40% | 45% | 50% | 55% | 60% | 65% | 70% |
| 30 | 10.6 | 12.0 | 13.3 | 14.7 | 16.0 | 17.4 | 18.8 |
| 29 | 10.0 | 11.3 | 12.6 | 13.8 | 15.1 | 16.4 | 17.7 |
| 28 | 9.4 | 10.6 | 11.8 | 13.0 | 14.3 | 15.5 | 16.7 |
| 27 | 8.9 | 10.0 | 11.1 | 12.3 | 13.4 | 14.6 | 15.7 |
| 26 | 8.4 | 9.4 | 10.5 | 11.6 | 12.6 | 13.7 | 14.8 |
| 25 | 7.9 | 8.9 | 9.9 | 10.9 | 11.9 | 12.9 | 13.9 |

FIG.4

| ROOM TEMPERATURE [°C] | DEW-POINT TEMPERATURE [°C] WITH RESPECT TO ROOM TEMPERATURE AND RELATIVE HUMIDITY | | | | | | |
|---|---|---|---|---|---|---|---|
| | 40% | 45% | 50% | 55% | 60% | 65% | 70% |
| 30 | 14.9 | 16.8 | 18.4 | 20.0 | 21.4 | 22.7 | 23.9 |
| 29 | 14.0 | 15.9 | 17.5 | 19.0 | 20.4 | 21.7 | 23.0 |
| 28 | 13.1 | 15.0 | 16.6 | 18.1 | 19.5 | 20.8 | 22.0 |
| 27 | 12.2 | 14.1 | 15.7 | 17.2 | 18.6 | 19.9 | 21.1 |
| 26 | 11.4 | 13.2 | 14.8 | 16.3 | 17.6 | 18.9 | 20.1 |
| 25 | 10.5 | 12.2 | 13.9 | 15.3 | 16.7 | 18.0 | 19.1 |

AIR CONDITIONING APPARATUS AND AIR CONDITIONING CONTROL METHOD

FIELD OF THE INVENTION

The present disclosure relates to an air conditioning apparatus and an air conditioning control method. For example, the present disclosure relates to an air conditioning apparatus and an air conditioning control method that maintain a preferred absolute humidity during sleep in a bedroom even with rather high cooling temperature setting in air conditioning control at summer night.

BACKGROUND ART

Until now, there have been developed various air conditioning apparatus (air conditioner) control methods for making a temperature environment during sleep more suitable for sleep in order to improve the quality of sleep which is said to occupy one-third of the lifetime. Further, a metabolic rate of a human body during sleep is lower than that when awake. Thus, when normal air conditioning control is performed, it is not possible to obtain comfortable sleep. Thus, there has been conventionally conceived a bedtime mode called, for example, a "sleep mode" as a cooling operation mode suitable for sleep, and a cooling operation based on the bedtime mode has been performed.

For example, JP 3999608 B2 discloses an air conditioner described below. The air conditioner performs a cooling operation based on bedtime mode control. When a state in which a compressor rotation speed is lower than a predetermined level and the difference between an air conditioning target temperature and an indoor detected temperature is equal to or smaller than a predetermined value or a state in which an indoor detected humidity is higher than a set humidity based on an operation during bedtime has continued for a predetermined time or more in a cooling operation in a gradually increasing area, the air conditioner performs an excessive throttle cooling operation in which the degree of opening of an electronic expansion valve which is disposed between an outdoor heat exchanger and an indoor heat exchanger is brought into an excessively throttled state compared to that during a normal cooling operation.

Further, JP 2001-280668 A discloses an air conditioner described below. In a reheating dry operation of the air conditioner which is provided with a refrigerating cycle including a compressor, an outdoor heat exchanger, an indoor heat exchanger, a bypass valve, and a bleed port valve and electronic components such as an inverter device, an outdoor fan, and an indoor fan, when the inverter device is cooled, heat exchange in the outdoor heat exchanger is made minimum, and the amount of refrigerant fed to the indoor heat exchanger is increased.

Further, JP 3446792 B2 discloses an air conditioner as described below. The air conditioner constitutes a refrigerating cycle which divides the flow of a refrigerant obtained by a compressor through an outdoor heat exchanger, an expansion valve, and a flow divider and circulates the refrigerant to the compressor through an indoor heat exchanger which supplies the refrigerant to two refrigerant paths from an entrance using an on-off valve disposed in one of the refrigerant paths. The air conditioner is provided with a temperature sensor which detects the temperature at an exit of the expansion valve and the temperature at an intermediate part of the indoor heat exchanger. In a dehumidification operation, the air conditioner controls the compressor at a low speed, and controls opening and closing of the on-off valve according to the temperature difference between a room temperature and a set temperature. The air conditioner controls a throttle amount of the expansion valve so that the temperature difference between the temperature at the exit of the expansion valve and the temperature at the intermediate part of the indoor heat exchanger becomes a predetermined reference value to variably control a liquid range of the refrigerant flowing through the indoor heat exchanger to switch a dehumidification capacity by stages.

Further, JP 3011708 B1 discloses an air conditioner as described below. In the air conditioner, an outdoor unit which includes a variable-capacity compressor, a four-way valve, an outdoor heat exchanger, and a pressure reducer and an indoor unit which includes an indoor heat exchanger are connected to each other. In the dehumidification operation, the angle of an air direction changing blade which is rotatably disposed on the indoor unit is set to a closing position for closing a blow-off port of the indoor unit or near the closing position.

However, it is difficult for the air conditioning apparatuses as described above to achieve an appropriate temperature and an appropriate humidity when the temperature setting is rather high temperature setting with which the cooling operation is difficult to operate. Thus, further improvement is required.

SUMMARY OF THE INVENTION

The present disclosure has been made to solve the above problems, and an object thereof is to provide an air conditioning apparatus and an air conditioning control method that are capable of achieving an appropriate temperature and an appropriate humidity even with rather high temperature setting with which a cooling operation is difficult to operate.

An air conditioning apparatus according to one aspect of the present disclosure includes: a first acquisition section that acquires a first absolute humidity indicating a target absolute humidity determined from a first temperature indicating a previously set temperature and a first relative humidity indicating a previously set relative humidity; a second acquisition section that acquires a dew-point temperature determined from the first temperature and the first relative humidity; a third acquisition section that acquires a second absolute humidity indicating an absolute humidity inside a room, the absolute humidity being determined from a second temperature indicating a temperature inside the room and a second relative humidity indicating a relative humidity inside the room; a heat exchanger that exchanges heat between air inside the room and a refrigerant; an air blower that blows air cooled by the heat exchanger, an air outlet for blowing air blown by the air blower into the room; and a control section that controls a dehumidification operation that stops air-blowing of the air blower, closes the air outlet, and cools the heat exchanger at the dew-point temperature when the second absolute humidity is higher than the first absolute humidity.

BRIEF DESCRIPTION OF THE DRAWINGS

FIG. 3 is a diagram illustrating an example of an absolute humidity translation table which is used by an absolute humidity set value calculation section illustrated in FIG. 2 to obtain an absolute humidity;

FIG. 4 is a diagram illustrating an example of a dew-point temperature translation table which is used by a dew-point temperature calculation section illustrated in FIG. 2 to obtain a dew-point temperature;

DESCRIPTION OF EMBODIMENTS

Knowledge Forming Basis of the Present Disclosure

JP 3999608 B2 described above has a problem in that an operation stopped period of the cooling operation increases, which causes discomfort at the point when the humidity increases at dawn in summer.

In JP 2001-280668 A, after the cooling operation is activated, air reheated to a temperature set by a user is blown into the room so that the inside of the room is not excessively cooled. Thus, an appropriate temperature and an appropriate humidity can be both achieved. However, there is a problem in that the energy efficiency is low due to the reheating after cooling.

In JP 3446792 B2, the indoor unit is provided with the two heat exchangers. One of the heat exchangers is controlled for cooling at rather high temperature, and the other heat exchanger is controlled for dehumidification at rather low temperature to perform dehumidification that does not excessively lower the room temperature. That is, the dedicated heat exchangers whose cooling temperatures can be controlled in divided areas are used. Thus, there is a problem in that the component cost of the heat exchangers increases.

In JP 3011708 B1, although a cold air feeling is suppressed by closing the blow-off port of the indoor unit, the cooling operation is a normal operation. Thus, similarly to JP 3999608 B1, there is a problem in that discomfort caused by a humidity rise at dawn in summer is left.

Figure 1:
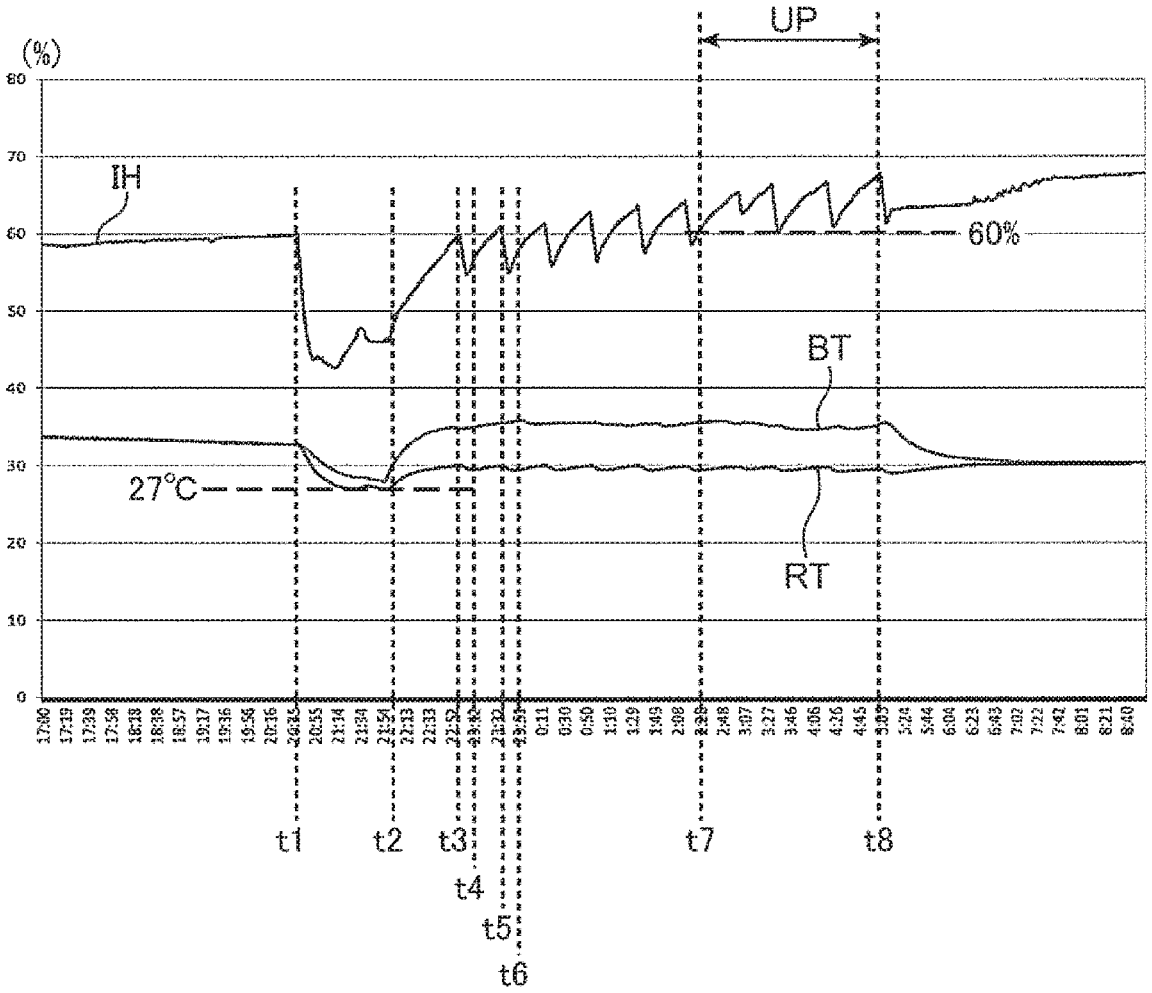
FIG. 1 is a diagram illustrating an example of a state change of an indoor temperature, an indoor relative temperature, and an in-bed temperature while a subject is sleeping in a bedroom.

The inventors of the present application have focused on the above problems and made earnest studies of the sleeping environment through a subject experiment. As a result, it has been found that, in the cooling operation based on the bedtime mode as described above, a humidity rise is one of the factors that interfere with comfortable sleep at dawn in summer. FIG. 1 is a diagram illustrating an example of a state change of an indoor temperature, an indoor relative temperature, and an in-bed temperature while a subject is sleeping in a bedroom.

As illustrated in FIG. 1, first, the temperature of a cooling operation of an air conditioning apparatus is set to 27° C. at a cooling start time t1, and an indoor temperature RT drops to 27° C. Then, at a bedtime t2, the temperature of the cooling operation is changed to 28° C., and the subject goes to bed and falls asleep. Then, the cooling operation is in a stopped state until a cooling operation start time t3 at which the indoor temperature RT becomes 30° C. which is 2° C. higher than the set temperature 28° C., and the cooling operation is brought into an operating state at the cooling operation start time t3. Then, when the indoor temperature RT reaches the set temperature 28° C. at a cooling operation stop time t4, the cooling operation is brought into a stopped state. Thereafter, the cooling operation is started at a cooling operation start time t5 and stopped at a cooling operation stop time t6, and starting and stopping of the cooling operation are repeated.

At this time, an open-air temperature, that is, an outdoor temperature during night is equal to or lower than 30° C. even in summer due to the lack of direct sunlight and becomes the lowest temperature at dawn. The outdoor temperature may become equal to or lower than 25° C. When the outdoor temperature is lower than the set temperature of the cooling operation inside the room, a period required for the indoor temperature to reach the cooling operation start temperature becomes long. When a stopped state of the cooling operation becomes long, a dehumidification capacity by the air conditioning apparatus is reduced, which gradually increases an indoor relative humidity IH.

An in-bed temperature BT and the indoor temperature RT hardly change. However, the indoor relative humidity TH exceeds 60% at a discomfort relative humidity start time t7, and a discomfort period UP during which the relative humidity is higher than 60% is generated. Thus, the subject gets up due to a bad sleep at a time t8 although the subject wants to have more sleep. As a result, it has been found that air conditioning control that achieves both an appropriate temperature and an appropriate humidity (50% range) in a bedroom during sleep is important. Although, in the example of FIG. 1, the set temperature of the cooling operation during bedtime is 28° C., the set temperature may be a temperature other than 28° C. Further, although the indoor temperature at the cooling operation start is +2° C. of the set temperature in the example, the indoor temperature may vary according to specifications of a manufacturer of the air conditioning apparatus.

In view of the result of the subject experiment described above, the inventors of the present application have made earnest studies on how to achieve an appropriate temperature and an appropriate humidity with high energy efficiency and low cost without excessively lowering the sensible temperature when the temperature setting is rather high temperature setting with which the cooling operation is difficult to operate, and have completed the present disclosure.

An air conditioning apparatus according to one aspect of the present disclosure includes: a first acquisition section that acquires a first absolute humidity indicating a target absolute humidity determined from a first temperature indicating a previously set temperature and a first relative humidity indicating a previously set relative humidity; a second acquisition section that acquires a dew-point temperature determined from the first temperature and the first relative humidity; a third acquisition section that acquires a second absolute humidity indicating an absolute humidity inside a room, the absolute humidity being determined from a second temperature indicating a temperature inside the room and a second relative humidity indicating a relative humidity inside the room; a heat exchanger that exchanges heat between air inside the room and a refrigerant; an air blower that blows air cooled by the heat exchanger; an air outlet for blowing air blown by the air blower into the room; and a control section that controls a dehumidification operation that stops air-blowing of the air blower, closes the air outlet, and cools the heat exchanger at the dew-point temperature when the second absolute humidity is higher than the first absolute humidity.

With such a configuration, the first absolute humidity indicating the target absolute humidity determined from the first temperature indicating the previously set temperature and the first relative humidity indicating the previously set relative humidity is acquired, the dew-point temperature determined from the first temperature and the first relative humidity is acquired, and the second absolute humidity indicating the absolute humidity inside the room, the absolute humidity being determined from the second temperature indicating the temperature inside the room and the second relative humidity indicating the relative humidity inside the room is acquired. When the second absolute humidity is higher than the first absolute humidity, the dehumidification operation is performed which stops the air-blowing of the air blower that blows air cooled by the heat exchanger that exchanges heat between air inside the room and the refrigerant, closes the air outlet for blowing air blown by the air blower into the room, and cools the heat exchanger at the dew-point temperature. Thus, it is possible to achieve an appropriate temperature and an appropriate humidity without excessively lowering the sensible temperature. Further, since a reheating process for preventing excessive cooling is not performed, humidity control of the air conditioning apparatus with high energy efficiency can be performed. Further, since no special heat exchanger is used, humidity control of the air conditioning apparatus with low component cost can be performed. As a result, it is possible to achieve an appropriate temperature and an appropriate humidity with high energy efficiency and low cost without excessively lowering the sensible temperature even with rather high temperature setting with which the cooling operation is difficult to operate.

The first acquisition section may include a first calculation section that acquires the first temperature and the first relative humidity and calculates the first absolute humidity from the first temperature and the first relative humidity, the second acquisition section may include a second calculation section that acquires the first temperature and the first relative humidity and calculates the dew-point temperature from the first temperature and the first relative humidity, and the third acquisition section may include a third calculation section that acquires the second temperature and the second relative humidity and calculates the second absolute humidity from the second temperature and the second relative humidity.

With such a configuration, the first temperature and the first relative humidity are acquired, the first absolute humidity is calculated from the first temperature and the first relative humidity, and the dew-point temperature is calculated from the first temperature and the first relative humidity. Further, the second temperature and the second relative humidity are acquired, and the second absolute humidity is calculated from the second temperature and the second relative humidity. Thus, it is possible to acquire the target absolute humidity, the dew-point temperature, and the absolute humidity inside the room with high accuracy.

The control section may continue cooling of the heat exchanger while the second absolute humidity is higher than the first absolute humidity.

With such a configuration, since the cooling of the heat exchanger is continued while the second absolute humidity is higher than the first absolute humidity, it is possible to maintain the inside of the room in a state with an appropriate temperature and an appropriate humidity.

The control section may continue cooling of the heat exchanger while a temperature of the heat exchanger is not lower than the dew-point temperature.

With such a configuration, since the cooling of the heat exchanger is continued while the temperature of the heat exchanger is not lower than the dew-point temperature, it is possible to maintain the inside of the room in a state with an appropriate temperature and an appropriate humidity.

The air conditioning apparatus may further include a fourth acquisition section that acquires a third temperature indicating a temperature outside the room, and the control section may start the dehumidification operation when the first temperature or the second temperature is higher than the third temperature.

With such a configuration, the third temperature indicating the temperature outside the room is acquired, and the dehumidification operation is started when the first temperature or the second temperature is higher than the third temperature. Thus, when the previously set temperature or the temperature inside the room is higher than the temperature outside the room, the dehumidification operation can be started, and it is possible to maintain the inside of the room in a state with an appropriate temperature and an appropriate humidity.

The control section may cool the heat exchanger so that a temperature of the heat exchanger falls within a predetermined range including the dew-point temperature after the second absolute humidity reaches the first absolute humidity in the dehumidification operation.

With such a configuration, the heat exchanger is cooled so that the temperature of the heat exchanger falls within the predetermined range including the dew-point temperature after the second absolute humidity reaches the first absolute humidity in the dehumidification operation. Thus, it is possible to maintain the inside of the room in a state with an appropriate temperature and an appropriate humidity while preventing the temperature inside the room from becoming too low.

An air conditioning apparatus according to another aspect of the present disclosure includes: a first acquisition section that acquires a first temperature indicating a previously set temperature; a second acquisition section that acquires a second temperature indicating a temperature inside a room; a heat exchanger that exchanges heat between air inside the room and a refrigerant; an air blower that blows air cooled by the heat exchanger, an air outlet for blowing air blown by the air blower into the room; a control section that controls a cooling operation that causes the air blower to blow air, opens the air outlet, and cools the heat exchanger so that the second temperature becomes the first temperature and a dehumidification operation that dehumidifies the inside of the room by cooling the heat exchanger; and a determination section that determines switching between the cooling operation and the dehumidification operation. The determination section determines the switching from the cooling operation to the dehumidification operation according to the difference between an operating time and a stopped time of the cooling operation, the operating time and the stopped time being adjacent to each other in the time series. The control section switches the cooling operation to the dehumidification operation according to a result of the determination of the switching from the cooling operation to the dehumidification operation.

With such a configuration, the first temperature indicating the previously set temperature is acquired, and the second temperature indicating the temperature inside the room is acquired. Further, the cooling operation that causes the air blower that blows air cooled by the heat exchanger that exchanges heat between air inside the room and the refrigerant to blow air, opens the air outlet for blowing air blown by the air blower into the room, and cools the heat exchanger so that the second temperature becomes the first temperature and the dehumidification operation that dehumidifies the inside of the room by cooling the heat exchanger are controlled. At this time, the switching from the cooling operation to the dehumidification operation is determined according to the difference between the operating time and the stopped time of the cooling operation, the operating time and the stopped time being adjacent to each other in the time series, and the cooling operation is switched to the dehumidification operation according to a result of the determination of the switching from the cooling operation to the dehumidification operation. Thus, it is possible to switch the cooling operation to the dehumidification operation before the relative humidity inside the room rises to cause discomfort. As a result, it is possible to achieve an appropriate temperature and an appropriate humidity without excessively lowering the sensible temperature even with rather high temperature setting with which the cooling operation is difficult to operate.

The control section may stop the air-blowing of the air blower and close the air outlet in the dehumidification operation.

With such a configuration, the air-blowing of the air blower is stopped, and the air outlet is closed in the dehumidification operation. Thus, dehumidified cold air is not directly blown into the room, and it is possible to bring the inside of the room into a state with an appropriate temperature and an appropriate humidity.

The operating time of the cooling operation may include a cooling time of the heat exchanger.

With such a configuration, the switching from the cooling operation to the dehumidification operation is determined on the basis of the cooling time of the heat exchanger. Thus, it is possible to reliably switch the cooling operation to the dehumidification operation before the relative humidity inside the room rises to cause discomfort.

The determination section may determine the switching from the cooling operation to the dehumidification operation when the difference between the operating time and the stopped time of the cooling operation becomes equal to or larger than a predetermined threshold.

With such a configuration, when the difference between the operating time and the stopped time of the cooling operation becomes equal to or larger than the predetermined threshold, the switching from the cooling operation to the dehumidification operation is determined. Thus, it is possible to reliably switch the cooling operation to the dehumidification operation before the relative humidity inside the room rises to cause discomfort.

The air conditioning apparatus may further include: a third acquisition section that acquires a first relative humidity indicating a previously set relative humidity; a fourth acquisition section that acquires a second relative humidity indicating a relative humidity inside the room; a first calculation section that calculates a first absolute humidity indicating a target absolute humidity inside the room from the first temperature and the first relative humidity; a second calculation section that calculates a dew-point temperature from the first temperature and the first relative humidity; and a third calculation section that calculates a second absolute humidity indicating an absolute humidity inside the room from the second temperature and the second relative humidity. The control section may stop the air-blowing of the air blower, close the air outlet, and cool the heat exchanger at the dew-point temperature as the dehumidification operation when the second absolute humidity is higher than the first absolute humidity.

With such a configuration, the first relative humidity indicating the previously set relative humidity is acquired, and the second relative humidity indicating the relative humidity inside the room is acquired. Further, the first absolute humidity indicating the target absolute humidity inside the room is calculated from the first temperature and the first relative humidity, the dew-point temperature is calculated from the first temperature and the first relative humidity, and the second absolute humidity indicating the absolute humidity inside the room is calculated from the second temperature and the second relative humidity. At this time, the air-blowing of the air blower is stopped, the air outlet is closed, and the heat exchanger is cooled at the dew-point temperature as the dehumidification operation when the second absolute humidity is higher than the first absolute humidity. Thus, it is possible to achieve an appropriate temperature and an appropriate humidity without excessively lowering the sensible temperature. Further, since a reheating process for preventing excessive cooling is not performed, humidity control of the air conditioning apparatus with high energy efficiency can be performed. Further, since no special heat exchanger is used, humidity control of the air conditioning apparatus with low component cost can be performed. As a result, it is possible to achieve an appropriate temperature and an appropriate humidity with high energy efficiency and low cost without excessively lowering the sensible temperature even with rather high temperature setting with which the cooling operation is difficult to operate.

An air conditioning apparatus according to still another aspect of the present disclosure includes: a first acquisition section that acquires a first temperature indicating a previously set temperature; a second acquisition section that acquires a second temperature indicating a temperature inside a room; a third acquisition section that acquires a third temperature indicating a temperature outside the room; a heat exchanger that exchanges heat between air inside the room and a refrigerant; an air blower that blows air cooled by the heat exchanger; an air outlet for blowing air blown by the air blower into the room; a control section that controls a cooling operation that causes the air blower to blow air, opens the air outlet, and cools the heat exchanger so that the second temperature becomes the first temperature and a dehumidification operation that dehumidifies the inside of the room by cooling the heat exchanger, and a determination section that determines switching between the cooling operation and the dehumidification operation. The determination section determines the switching from the cooling operation to the dehumidification operation according to the difference between the first temperature or the second temperature and the third temperature. The control section switches the cooling operation to the dehumidification operation according to a result of the determination of the switching from the cooling operation to the dehumidification operation.

With such a configuration, the first temperature indicating the previously set temperature is acquired, the second temperature indicating the temperature inside the room is acquired, and the third temperature indicating the temperature outside the room is acquired. Further, the cooling operation that causes the air blower that blows air cooled by the heat exchanger that exchanges heat between air inside the room and the refrigerant to blow air, opens the air outlet for blowing air blown by the air blower into the room, and cools the heat exchanger so that the second temperature becomes the first temperature and the dehumidification operation that dehumidifies the inside of the room by cooling the heat exchanger are controlled. At this time, the switching from the cooling operation to the dehumidification operation is determined according to the difference between the first temperature or the second temperature and the third temperature, and the cooling operation is switched to the dehumidification operation according to a result of the determination of the switching from the cooling operation to the dehumidification operation. Thus, it is possible to switch the cooling operation to the dehumidification operation before the relative humidity inside the room rises to cause discomfort. As a result, it is possible to achieve an appropriate temperature and an appropriate humidity without excessively lowering the sensible temperature even with rather high temperature setting with which the cooling operation is difficult to operate.

The control section may stop the air-blowing of the air blower and close the air outlet in the dehumidification operation.

With such a configuration, the air-blowing of the air blower is stopped, and the air outlet is closed in the dehumidification operation. Thus, dehumidified cold air is not directly blown into the room, and it is possible to bring the inside of the room into a state with an appropriate temperature and an appropriate humidity.

The determination section may determine the switching from the cooling operation to the dehumidification operation when the difference between the first temperature or the second temperature and the third temperature becomes equal to or larger than a predetermined threshold.

With such a configuration, when the difference between the first temperature or the second temperature and the third temperature becomes equal to or larger than the predetermined threshold, the switching from the cooling operation to the dehumidification operation is determined. Thus, it is possible to reliably switch the cooling operation to the dehumidification operation before the relative humidity inside the room rises to cause discomfort.

Further, the present disclosure can be implemented not only as the air conditioning apparatus having the above characteristic configuration, but also as an air conditioning control method that executes a characteristic process corresponding to the characteristic configuration of the air conditioning apparatus using a processor. Thus, effects similar to the effects of the above air conditioning apparatus can be obtained also by other aspects described below.

An air conditioning control method according to still another aspect of the present disclosure is a method for controlling an air conditioning apparatus using a processor, the air conditioning apparatus including a heat exchanger that exchanges heat between air inside a room and a refrigerant, an air blower that blows air cooled by the heat exchanger, and an air outlet for blowing air blown by the air blower into the room. The air conditioning control method includes: acquiring a first absolute humidity indicating a target absolute humidity determined from a first temperature indicating a previously set temperature and a first relative humidity indicating a previously set relative humidity; acquiring a dew-point temperature determined from the first temperature and the first relative humidity; acquiring a second absolute humidity indicating an absolute humidity inside the room, the absolute humidity being determined from a second temperature indicating a temperature inside the room and a second relative humidity indicating a relative humidity inside the room; and controlling a dehumidification operation that stops air-blowing of the air blower, closes the air outlet, and cools the heat exchanger at the dew-point temperature when the second absolute humidity is higher than the first absolute humidity.

An air conditioning control method according to still another aspect of the present disclosure is a method for controlling an air conditioning apparatus using a processor, the air conditioning apparatus including a heat exchanger that exchanges heat between air inside a room and a refrigerant, an air blower that blows air cooled by the heat exchanger, and an air outlet for blowing air blown by the air blower into the room. The air conditioning control method includes: acquiring a first temperature indicating a previously set temperature; acquiring a second temperature indicating a temperature inside the room; determining switching between a cooling operation that causes the air blower to blow air, opens the air outlet, and cools the heat exchanger so that the second temperature becomes the first temperature and a dehumidification operation that dehumidifies the inside of the room by cooling the heat exchanger according to the difference between an operating time and a stopped time of the cooling operation, the operating time and the stopped time being adjacent to each other in the time series, and switching the cooling operation to the dehumidification operation according to a result of the determination of the switching from the cooling operation to the dehumidification operation.

An air conditioning control method according to still another aspect of the present disclosure is a method for controlling an air conditioning apparatus using a processor, the air conditioning apparatus including a heat exchanger that exchanges heat between air inside a room and a refrigerant, an air blower that blows air cooled by the heat exchanger, and an air outlet for blowing air blown by the air blower into the room. The air conditioning control method includes: acquiring a first temperature indicating a previously set temperature; acquiring a second temperature indicating a temperature inside a room; acquiring a third temperature indicating a temperature outside the room, determining switching between a cooling operation that causes the air blower to blow air, opens the air outlet, and cools the heat exchanger so that the second temperature becomes the first temperature and a dehumidification operation that dehumidifies the inside of the room by cooling the heat exchanger according to the difference between the first temperature or the second temperature and the third temperature, and switching the cooling operation to the dehumidification operation according to a result of the determination of the switching from the cooling operation to the dehumidification operation.

Embodiments described below are comprehensive and concrete examples. Further, numerical values, shapes, elements, steps, and the order of the steps are merely examples, and have no intention to limit the present disclosure. Further, among the elements in the following embodiments, elements that are not described in an independent claim that shows the most generic concept are described as optional elements. Further, in all of the embodiments, contents can be combined in any manner.

Hereinafter, embodiments of the present disclosure will be described with reference to the drawings.

First Embodiment

Figure 2:
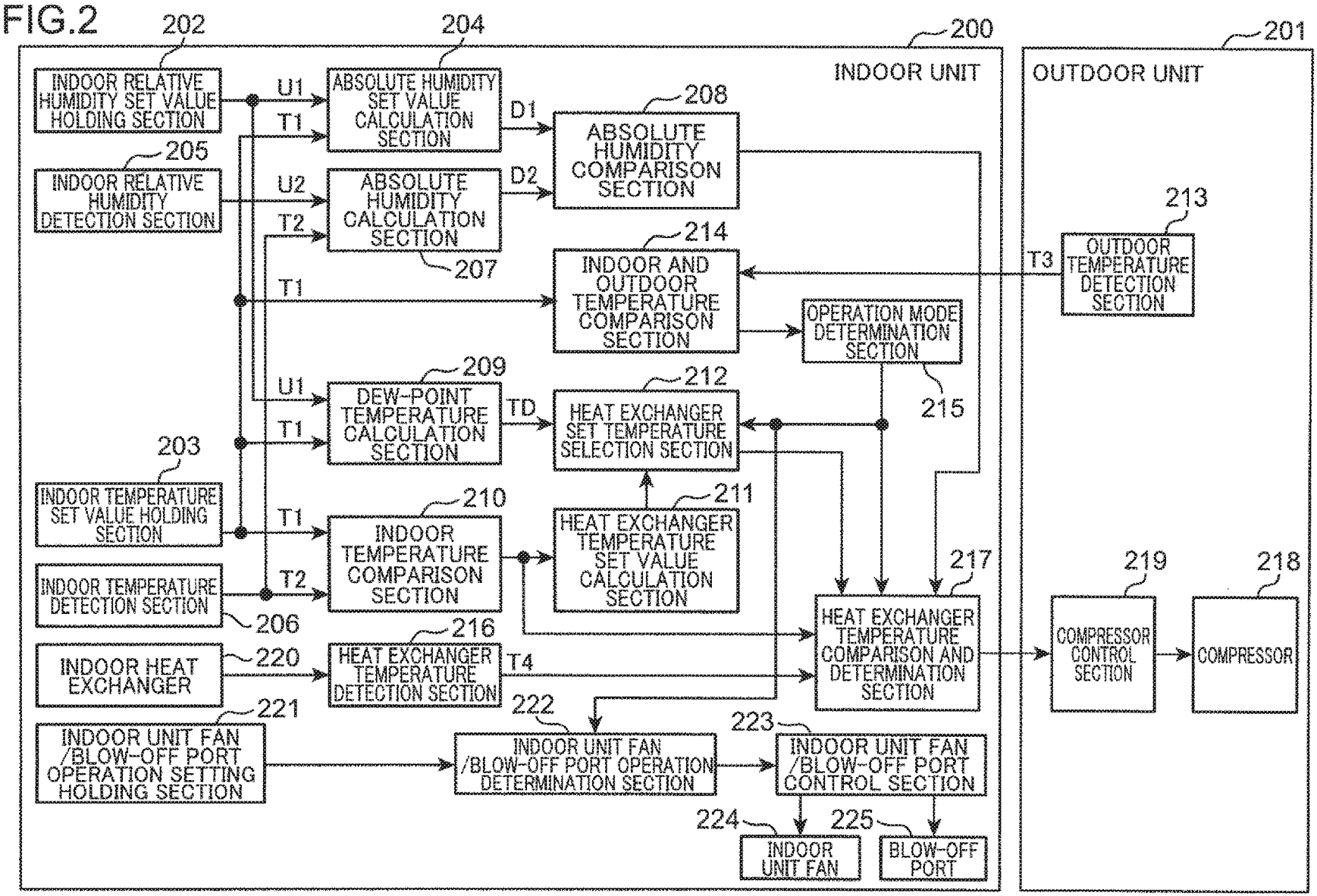
FIG. 2 is a block diagram illustrating an example of the configuration of an air conditioning apparatus in a first embodiment of the present disclosure.

FIG. 2 is a block diagram illustrating an example of the configuration of an air conditioning apparatus in a first embodiment of the present disclosure. The air conditioning apparatus illustrated in FIG. 2 includes, for example, an air conditioner, and is provided with an indoor unit 200 and an outdoor unit 201.

The indoor unit 200 is provided with an indoor relative humidity set value holding section 202, an indoor temperature set value holding section 203, an absolute humidity set value calculation section 204, an indoor relative humidity detection section 205, an indoor temperature detection section 206, an absolute humidity calculation section 207, an absolute humidity comparison section 208, a dew-point temperature calculation section 209, an indoor temperature comparison section 210, a heat exchanger temperature set value calculation section 211, a heat exchanger set temperature selection section 212, an indoor and outdoor temperature comparison section 214, an operation mode determination section 215, a heat exchanger temperature detection section 216, a heat exchanger temperature comparison and determination section 217, an indoor heat exchanger 220, an indoor unit fan/blow-off port operation setting holding section 221, an indoor unit fan/blow-off port operation determination section 222, an indoor unit fan/blow-off port control section 223, an indoor unit fan 224, and an blow-off port 225. The outdoor unit 201 is provided with an outdoor temperature detection section 213, a compressor 218, and a compressor control section 219.

The indoor relative humidity set value holding section 202 acquires and holds a set value of a relative humidity inside a room such as a bedroom, the set value being set by a user or a manufacturer of the air conditioning apparatus, as a set relative humidity U1. The set relative humidity U1 is an example of the first relative humidity indicating the previously set relative humidity.

The relative humidity is expressed by a value [% RH] indicating how much water is contained relative to the maximum water content (the saturated water vapor amount) that can be contained in the air having a certain temperature. For example, the relative humidity 100% RH indicates a state in which no more water vapor can be contained in the air (saturated air). The saturated water vapor amount increases as the temperature rises and decreases as the temperature drops. Thus, even when the water content is constant, the relative humidity changes as the temperature changes. It's hard to sleep when the relative humidity inside a room is higher than 60% RH. Thus, a value within the range of 50 to 60% RH can be used as the set relative humidity U1. In the present embodiment, for example, 50% RH is used. The set relative humidity U1 is not particularly limited to this example, and various values that are comfortable humidity for a user can be used.

The indoor temperature set value holding section 203 acquires and holds a set value of the temperature inside the room such as a bedroom, the set value being set by a user or the manufacturer of the air conditioning apparatus, as a set temperature T1. The set temperature T1 is an example of the first temperature indicating the previously set temperature.

The absolute humidity set value calculation section 204 acquires a target absolute humidity D1 which is determined from the set temperature T1 and the set relative humidity U1. Specifically, the absolute humidity set value calculation section 204 acquires the set temperature T1 from the indoor temperature set value holding section 203, acquires the set relative humidity U1 from the indoor relative humidity set value holding section 202, and calculates the target absolute humidity D1 from the set temperature T1 and the set relative humidity U1. The target absolute humidity D1 is an example of the first absolute humidity indicating the target absolute humidity inside the room, the target absolute humidity being a target value.

The absolute humidity includes a specific humidity (kg/kg (DA)) which indicates a water vapor content (kg) in 1 kg of dry air and a volumetric humidity (g/m$^3$) which indicates a water vapor content (g) in 1 m$^3$ of air. Even when the temperature changes, a value of the absolute humidity does not change. In the present embodiment, for example, the volumetric humidity (g/m$^3$) is used as the target absolute humidity D1. Specifically, a translation table which indicates the correspondence relationship of the absolute humidity with a principal temperature and a principal relative humidity is previously created using a psychrometric chart (graph) of the Tetens equation, and the absolute humidity is calculated using the translation table.

FIG. 3 is a diagram illustrating an example of an absolute humidity translation table which is used by the absolute humidity set value calculation section 204 illustrated in FIG. 2 to obtain the absolute humidity. In FIG. 3, for ease of expression, the relative humidity is expressed merely in percentages [%].

The absolute humidity set value calculation section 204 previously stores the absolute humidity translation table illustrated in FIG. 3 in, for example, an internal memory and calculates the target absolute humidity D1 from a room temperature indicated by the set temperature T1 and a relative humidity indicated by the set relative humidity U1. For example, when the room temperature indicated by the set temperature T1 is 28° C., and the relative humidity indicated by the set relative humidity U1 is 50%, the target absolute humidity D1 is calculated as 11.8 g/m$^3$.

The absolute humidity translation table illustrated in FIG. 3 is obtained by translating an arithmetic expression into a table. However, the absolute humidity translation table is not particularly limited to this example. For example, a translation table which is multiplied by an adjustment factor according to manufacturer specifications of the air conditioning apparatus, the size of the bedroom, and the positional relationship between the air conditioning apparatus and a bed may be used. Further, a method for calculating the absolute humidity is not particularly limited to the above example, and various changes can be made. For example, the absolute humidity may be calculated using an approximate expression of the known Tetens equation. The same applies to the absolute humidity calculation section 207 described below.

The indoor relative humidity detection section 205 includes, for example, a humidity sensor, and detects and acquires a relative humidity inside the room where the indoor unit 200 is installed as an indoor relative humidity U2. The indoor relative humidity U2 is an example of the second relative humidity indicating the current relative humidity inside the room.

The indoor temperature detection section 206 includes, for example, a temperature sensor, and detects and acquires a temperature inside the room such as a bedroom where the indoor unit 200 is installed as an indoor temperature T2. The indoor temperature T2 is an example of the second temperature indicating the current temperature inside the room.

The absolute humidity calculation section 207 acquires an indoor absolute humidity D2 which is determined from the indoor temperature T2 and the indoor relative humidity U2. Specifically, the absolute humidity calculation section 207 acquires the indoor temperature T2 from the indoor temperature detection section 206, acquires the indoor relative humidity U2 from the indoor relative humidity detection section 205, and calculates the indoor absolute humidity D2 from the indoor temperature T2 and the indoor relative humidity U2. The indoor absolute humidity D2 is an example of the second absolute humidity indicating the current absolute humidity inside the room. In the present embodiment, the absolute humidity calculation section 207, for example, calculates the indoor absolute humidity D2 from the indoor temperature T2 and the indoor relative humidity U2 using the absolute humidity translation table illustrated in FIG. 3 in a manner similar to the absolute humidity set value calculation section 204.

The absolute humidity comparison section 208 compares the current indoor absolute humidity D2 calculated by the absolute humidity calculation section 207 with the target absolute humidity D1 calculated by the absolute humidity set value calculation section 204, and calculates an absolute humidity difference Δt4 by subtracting the target absolute humidity D1 from the current indoor absolute humidity D2.

The dew-point temperature calculation section 209 acquires a dew-point temperature TD which is determined from the set temperature T1 and the set relative humidity U1. Specifically, the dew-point temperature calculation section 209 acquires the set temperature T1 from the indoor temperature set value holding section 203, acquires the set relative humidity U1 from the indoor relative humidity set value holding section 202, and calculates the dew-point temperature TD from the set temperature T1 and the set relative humidity U1.

The dew-point temperature indicates a temperature at which water in the air starts condensing by cooling the air. That is, the dew-point temperature is the temperature of the air in a state in which the relative humidity becomes 100% RH. In the present embodiment, for example, a translation table which indicates the correspondence relationship of the dew-point temperature with a temperature (dry bulb) and the relative humidity is previously created, the dew-point temperature is calculated using the translation table.

FIG. 4 is a diagram illustrating an example of a dew-point temperature translation table which is used by the dew-point temperature calculation section 209 illustrated in FIG. 2 to obtain the dew-point temperature. In FIG. 4, for ease of expression, the relative humidity is expressed merely in percentages [%].

The dew-point temperature calculation section 209 previously stores the dew-point temperature translation table illustrated in FIG. 4 in, for example, an internal memory and calculates the dew-point temperature TD from a room temperature indicated by the set temperature T1 and a relative humidity indicated by the set relative humidity U1. For example, when the room temperature indicated by the set temperature T1 is 28° C., and the relative humidity indicated by the set relative humidity U1 is 50%, the dew-point temperature TD is calculated as 16.6° C.

The dew-point temperature translation table illustrated in FIG. 4 is obtained by translating an arithmetic expression into a table. However, the dew-point temperature translation table is not particularly limited to this example. For example, a translation table which is multiplied by an adjustment factor according to manufacturer specifications of the air conditioning apparatus, the size of the bedroom, and the positional relationship between the air conditioning apparatus and the bed may be used. Further, a method for calculating the dew-point temperature is not particularly limited to the above example, and various changes can be made. For example, the dew-point temperature may be calculated using a known approximate expression.

The indoor temperature comparison section 210 compares the indoor temperature T2 detected by the indoor temperature detection section 206 with the set temperature T1 acquired from the indoor temperature set value holding section 203, and calculates a set temperature difference Δt1 by subtracting the set temperature T1 from the indoor temperature T2.

The heat exchanger temperature set value calculation section 211 calculates a set temperature HT for a cooling operation mode of the indoor heat exchanger 220 on the basis of the set temperature difference Δt1.

The outdoor temperature detection section 213 includes, for example, a temperature sensor, and detects and acquires a temperature in the open air where the outdoor unit 201 is installed, that is, outside the room as an outdoor temperature T3. The outdoor temperature T3 is an example of the third temperature indicating the temperature outside the room.

The indoor and outdoor temperature comparison section 214 compares the set temperature T1 acquired from the indoor temperature set value holding section 203 with the current outdoor temperature T3 detected by the outdoor temperature detection section 213, and calculates an indoor and outdoor temperature difference Δt2 by subtracting the outdoor temperature T3 from the set temperature T1. The indoor and outdoor temperature difference Δt2 is not particularly limited to the above example. For example, the indoor and outdoor temperature comparison section 214 may compare the current indoor temperature T2 detected by the indoor temperature detection section 206 with the current outdoor temperature T3 detected by the outdoor temperature detection section 213, and calculate the indoor and outdoor temperature difference Δt2 by subtracting the outdoor temperature T3 from the indoor temperature T2. In this example, when the indoor temperature T2 can be accurately detected, it is possible to accurately determine switching from the cooling operation mode to a forced condensation dehumidification operation mode (described below) and reliably bring the inside of the room into a state with an appropriate temperature and an appropriate humidity.

The operation mode determination section 215 determines whether the current operation mode is either the cooling operation mode or the forced condensation dehumidification operation mode on the basis of the indoor and outdoor temperature difference Δt2. The operation of the air conditioning apparatus by the cooling operation mode is an example of the cooling operation, and the operation of the air conditioning apparatus by the forced condensation dehumidification operation mode is an example of the dehumidification operation.

Specifically, the operation mode determination section 215 determines that the current operation mode is the forced condensation dehumidification operation mode when the indoor and outdoor temperature difference Δt2 is equal to or larger than a predetermined threshold 3 (e.g., 3° C.) and determines that the current operation mode is the cooling operation mode when the indoor and outdoor temperature difference Δt2 is not equal to or larger than the threshold 3. The threshold 3 is not particularly limited to the above example, and various values may be used as the threshold 3.

After the operation mode determination section 215 determines that the current operation mode is the forced condensation dehumidification operation mode, the operation mode determination section 215 determines that the current operation mode is the cooling operation mode when the indoor and outdoor temperature difference Δt2 is equal to or smaller than a predetermined threshold 6 (e.g., 0° C.) and determines that the current operation mode is the forced condensation dehumidification operation mode when the indoor and outdoor temperature difference Δt2 is not equal to or smaller than the threshold 6. The threshold 6 is not particularly limited to the above example, and various values may be used as the threshold 6.

The indoor unit fan/blow-off port operation setting holding section 221 previously holds and stores an operating state of each of the indoor unit fan 224 and the blow-off port 225, the operating state being set for each of the operation modes such as the cooling operation mode and the forced condensation dehumidification operation mode.

The indoor unit fan/blow-off port operation determination section 222 determines operations of the indoor unit fan 224 and the blow-off port 225, the operations corresponding to the operation mode determined by the operation mode determination section 215, with reference to the indoor unit fan/blow-off port operation setting holding section 221.

The indoor unit fan/blow-off port control section 223 controls the operations of the indoor unit fan 224 and the blow-off port control section 223 so as to be the operations determined by the indoor unit fan/blow-off port operation determination section 222.

The indoor unit fan 224 is an example of the air blower that blows air cooled by the indoor heat exchanger 220. The indoor unit fan 224 blows air cooled by the indoor heat exchanger 220 in the cooling operation mode and stops the air-blowing in the forced condensation dehumidification operation mode.

The blow-off port 225 is an example of the air outlet for blowing air blown by the indoor unit fan 224 into the room. The blow-off port 225 includes, for example, a louver. The blow-off port 225 is open in the cooling operation mode to adjust the direction of air blown into the room by the indoor unit fan 224 and closed in the forced condensation dehumidification operation mode.

Specifically, when the operation mode determination section 215 determines that the current operation mode is the cooling operation mode, the indoor unit fan/blow-off port control section 223 causes the indoor unit fan 224 to blow air and opens the blow-off port 225. When the operation mode determination section 215 determines that the current operation mode is the forced condensation dehumidification operation mode, the indoor unit fan/blow-off port control section 223 stops the indoor unit fan 224 and closes the blow-off port 225.

The operation of the forced condensation dehumidification operation is not particularly limited to the above example. For example, the indoor unit fan 224 may be caused to blow air and the blow-off port 225 may be opened in the forced condensation dehumidification operation. Further, a known dehumidification operation may be used instead of the forced condensation dehumidification operation. Examples of the known dehumidification operation system include a system that feeds air cooled for dehumidification by a heat exchanger as it is and a system that heats air cooled by a heat exchanger and then feeds the air. A dehumidification operation of any of the systems may be used. For example, a mild cooling dehumidification operation such as the excessive throttle cooling operation disclosed in JP 3999608 B may be used as the former system, and the reheating dry operation disclosed in JP 2001-280668 A may be used as the latter system.

When the operation mode determination section 215 determines that the current operation mode is the cooling operation mode, the heat exchanger set temperature selection section 212 selects the set temperature HT for the cooling operation mode, the set temperature HT being calculated by the heat exchanger temperature set value calculation section 211. When the operation mode determination section 215 determines that the current operation mode is the forced condensation dehumidification operation mode, the heat exchanger set temperature selection section 212 selects the dew-point temperature TD calculated by the dew-point temperature calculation section 209.

The indoor heat exchanger 220 is an example of the heat exchanger that exchanges heat between air inside the room and a refrigerant. Specifically, in the cooling operation mode and the forced condensation dehumidification operation mode, a refrigerant discharged from the compressor 218 is used. An outdoor heat exchanger (not illustrated) of the outdoor unit 201 serves as a condenser, and the indoor heat exchanger 220 serves as an evaporator to cool the air inside the room.

The heat exchanger temperature detection section 216 includes, for example, a temperature sensor, and detects a current temperature T4 of the indoor heat exchanger 220 as a heat exchanger temperature T4.

When the operation mode determination section 215 determines that the current operation mode is the cooling operation mode, the heat exchanger temperature comparison and determination section 217 compares the current temperature T4 of the indoor heat exchanger 220, the current temperature T4 being detected by the heat exchanger temperature detection section 216, with the set temperature HT for the cooling operation mode, the set temperature HT being selected by the heat exchanger set temperature selection section 212. The heat exchanger temperature comparison and determination section 217 controls the cooling operation which cools the indoor heat exchanger 220 so that the indoor temperature T2 becomes the set temperature T1 on the basis of a result of the comparison between the temperature T4 of the indoor heat exchanger 220 and the set temperature HT for the cooling operation mode. Specifically, the heat exchanger temperature comparison and determination section 217 controls the rotation of the compressor 218 using the compressor control section 219. The compressor control section 219 controls the rotation speed of the compressor 218 in the cooling operation mode in accordance with a control instruction from the heat exchanger temperature comparison and determination section 217.

On the other hand, when the operation mode determination section 215 determines that the current operation mode is the forced condensation dehumidification operation mode, the heat exchanger temperature comparison and determination section 217 compares the current temperature T4 of the indoor heat exchanger 220, the current temperature T4 being detected by the heat exchanger temperature detection section 216, with the dew-point temperature TD selected by the heat exchanger set temperature selection section 212. The heat exchanger temperature comparison and determination section 217 controls the forced condensation dehumidification operation which cools the indoor heat exchanger 220 at the dew-point temperature TD when the current indoor absolute humidity D2 is higher than the target absolute humidity D1 on the basis of a result of the comparison between the temperature T4 of the indoor heat exchanger 220 and the dew-point temperature TD. Specifically, the heat exchanger temperature comparison and determination section 217 controls the rotation of the compressor 218 using the compressor control section 219. The compressor control section 219 controls the rotation speed of the compressor 218 in the forced condensation dehumidification operation mode in accordance with a control instruction from the heat exchanger temperature comparison and determination section 217.

Further, when the set temperature T1 (or the indoor temperature T2) is higher than the outdoor temperature T3, the heat exchanger temperature comparison and determination section 217 starts the forced condensation dehumidification operation.

When the operation mode determination section 215 determines that the current operation mode is the forced condensation dehumidification operation mode, the heat exchanger temperature comparison and determination section 217 continuous the cooling of the indoor heat exchanger 220 at the dew-point temperature TD while the current indoor absolute humidity D2 is higher than the target absolute humidity D1. Further, the heat exchanger temperature comparison and determination section 217 continues the cooling of the indoor heat exchanger 220 while the temperature T4 of the indoor heat exchanger 220 is not lower than the dew-point temperature TD. In a forced condensation dehumidification operation, the heat exchanger temperature comparison and determination section 217 may cool the indoor heat exchanger 220 so that the indoor absolute humidity D2 falls within a predetermined range (e.g., within the range of 0.5° C.) including the target absolute humidity D1 after the indoor absolute humidity D2 reaches the target absolute humidity D1.

Specifically, when the operation mode is the cooling operation mode, the heat exchanger temperature comparison and determination section 217 determines whether the set temperature difference Δt1 calculated by the indoor temperature comparison section 210 is equal to or larger than a predetermined threshold 1 (e.g., 2° C.). The threshold 1 is not particularly limited to the above example, and various values can be used as the threshold 1.

When the set temperature difference Δt1 is equal to or larger than the threshold 1, the heat exchanger temperature comparison and determination section 217 turns on the compressor 218 using the compressor control section 219 to cool the indoor heat exchanger 220 at the set temperature HT. On the other hand, when the set temperature difference Δt1 is not equal to or larger than the threshold 1, the heat exchanger temperature comparison and determination section 217 turns off the compressor 218 using the compressor control section 219.

Further, after turning on the compressor 218, the heat exchanger temperature comparison and determination section 217 determines whether the set temperature difference Δt1 is equal to or smaller than a predetermined threshold 2 (e.g., 0° C.). The threshold 2 is not particularly limited to the above example, and various values may be used as the threshold 2.

When the set temperature difference Δt1 is equal to or smaller than the threshold 2, the heat exchanger temperature comparison and determination section 217 turns off the compressor 218 using the compressor control section 219. On the other hand, when the set temperature difference Δt1 is not equal to or smaller than the threshold 2, the heat exchanger temperature comparison and determination section 217 continues the ON operation of the compressor 218 to continue the cooling of the indoor heat exchanger 220 at the set temperature HT. As a result, the compressor 218 repeats the operation in which the compressor 218 is turned on when the set temperature difference Δt1 becomes equal to or larger than the threshold 1 and turned off when the set temperature difference Δt1 becomes equal to or smaller than the threshold 2. In this manner, the cooling operation is performed so that the indoor temperature T2 becomes the set temperature T1.

On the other hand, when the operation mode is the forced condensation dehumidification operation mode, the heat exchanger temperature comparison and determination section 217 compares the heat exchanger temperature T4 detected by the heat exchanger temperature detection section 216 with the dew-point temperature TD selected by the heat exchanger set temperature selection section 212, and calculates a heat exchanger temperature difference Δt3 by subtracting the dew-point temperature TD, which is a target value, from the current heat exchanger temperature T4. The heat exchanger temperature comparison and determination section 217 determines whether the heat exchanger temperature difference Δt3 is larger than a predetermined threshold 4 (e.g., 0° C.). The threshold 4 is not particularly limited to the above example, and various values can be used as the threshold 4.

When the heat exchanger temperature difference Δt3 is larger than the threshold 4, the heat exchanger temperature comparison and determination section 217 turns on the compressor 218 using the compressor control section 219 to cool the indoor heat exchanger 220 at the dew-point temperature TD. On the other hand, when the heat exchanger temperature difference Δt3 is not larger than the threshold 4, the heat exchanger temperature comparison and determination section 217 turns off the compressor 218 using the compressor control section 219.

Further, after turning on the compressor 218, the heat exchanger temperature comparison and determination section 217 determines whether the absolute humidity difference Δt4 is larger than a predetermined threshold 5 (e.g., 0 $g/m^3$). When the absolute humidity difference Δt4 is not larger than the threshold 5, the heat exchanger temperature comparison and determination section 217 turns off the compressor 218 using the compressor control section 219. The threshold 5 is not particularly limited to the above example, and various values may be used as the threshold 5.

As described above, the operation mode determination section 215 determines switching from the cooling operation to the forced condensation dehumidification operation according to the difference between the set temperature T1 (or the indoor temperature T2) and the outdoor temperature T3. Specifically, the operation mode determination section 215 determines switching from the cooling operation to the forced condensation dehumidification operation when the difference between the set temperature T1 (or the indoor temperature T2) and the outdoor temperature T3 becomes equal to or larger than the threshold 3.

Further, the heat exchanger temperature comparison and determination section 217 and the indoor unit fan/blow-off port control section 223 control the cooling operation which causes the indoor unit fan 224 to blow air, opens the blow-off port 225, and cools the indoor heat exchanger 220 so that the indoor temperature T2 becomes the set temperature T1. The heat exchanger temperature comparison and determination section 217 and the indoor unit fan/blow-off port control section 223 control the forced condensation dehumidification operation which stops the indoor unit fan 224, closes the blow-off port 225, and dehumidifies the inside of the room by cooling the indoor heat exchanger 220 at the dew-point temperature TD. Further, the heat exchanger temperature comparison and determination section 217 and the indoor unit fan/blow-off port control section 223 switch the cooling operation to the forced condensation dehumidification operation according to a result of the determination of the switching by the operation mode determination section 215.

In the present embodiment, the absolute humidity set value calculation section 204 is an example of the first acquisition section or the first calculation section, the dew-point temperature calculation section 209 is an example of the second acquisition section or the second calculation section, the absolute humidity calculation section 207 is an example of the third acquisition section or the third calculation section, and the heat exchanger temperature comparison and determination section 217 and the indoor unit fan/blow-off port control section 223 are examples of the control section. Further, the outdoor temperature detection section 213 is an example of the fourth acquisition section.

The indoor temperature set value holding section 203 is an example of another first acquisition section, the indoor temperature detection section 206 is an example of another second acquisition section, and the outdoor temperature detection section 213 is an example of another third acquisition section. The operation mode determination section 215 is an example of the determination section, and the heat exchanger temperature comparison and determination section 217 and the indoor unit fan/blow-off port control section 223 are an example of another control section.

Each of the absolute humidity set value calculation section 204, the dew-point temperature calculation section 209, the absolute humidity calculation section 207, the indoor temperature set value holding section 203, the operation mode determination section 215, the heat exchanger temperature comparison and determination section 217, and the indoor unit fan/blow-off port control section 223 includes, for example, a processor or a memory. In the present embodiment, the absolute humidity set value calculation section 204, the dew-point temperature calculation section 209, the absolute humidity calculation section 207, the operation mode determination section 215, the heat exchanger temperature comparison and determination section 217, and the indoor unit fan/blow-off port control section 223 are incorporated in the indoor unit 200. However, the present invention is not particularly limited to this example, and various changes can be made. For example, some or all of these sections may be incorporated in the outdoor unit 201 or incorporated in an external server.

Figure 5:
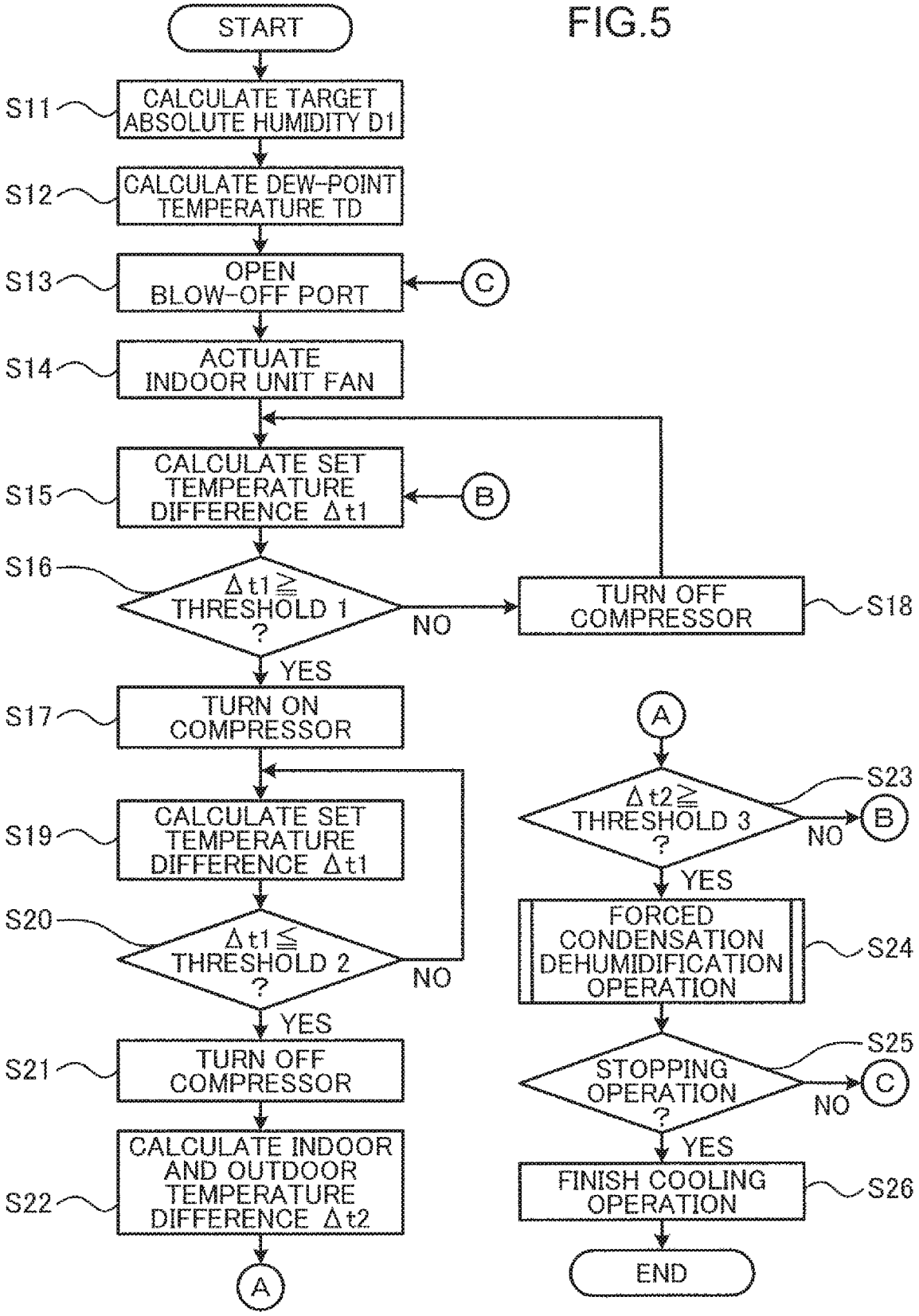
FIG. 5 is a flowchart illustrating an example of a humidity control process of the air conditioning apparatus illustrated in FIG. 2.
Figure 6:
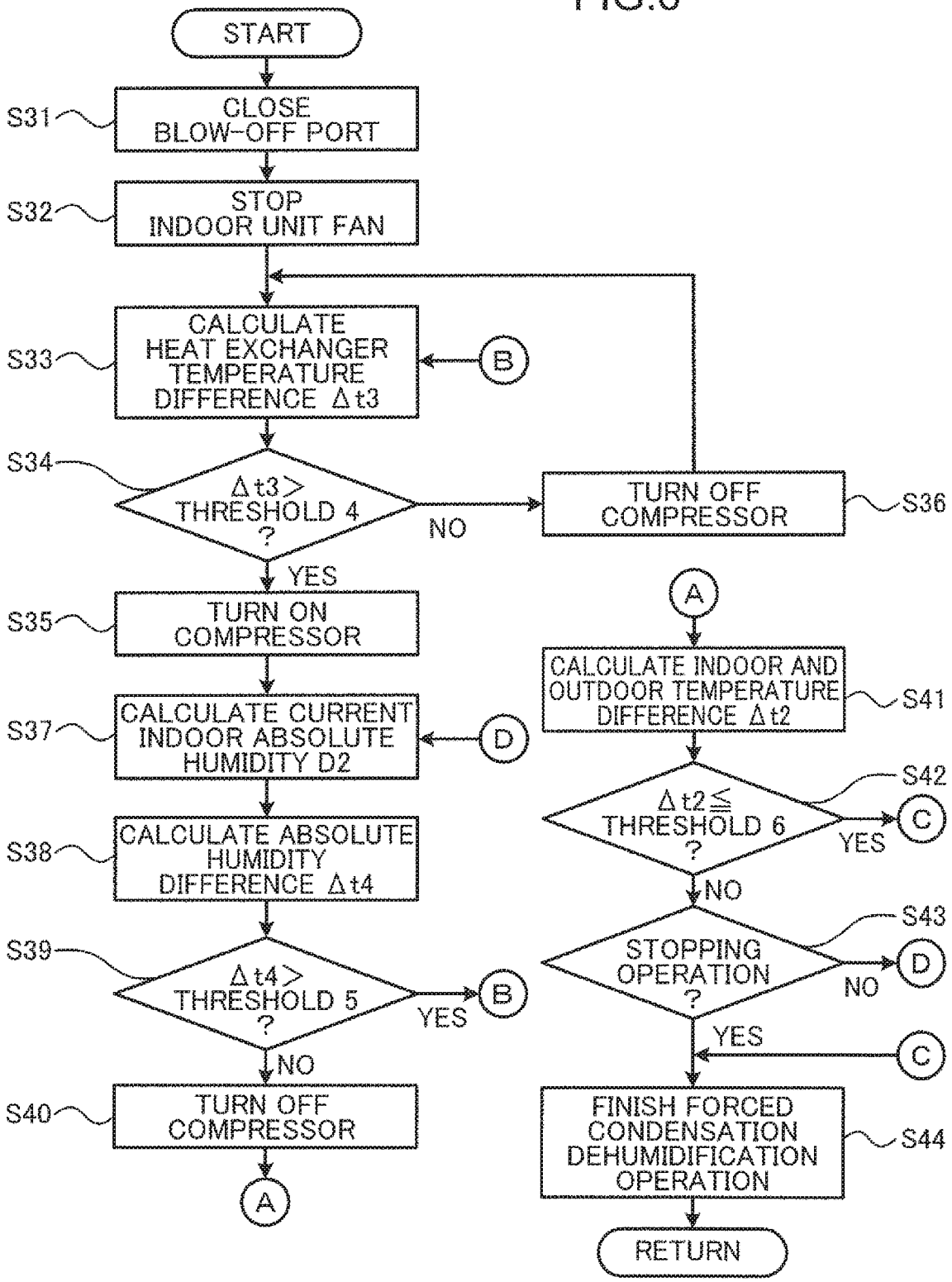
FIG. 6 is a flowchart illustrating an example of a forced condensation dehumidification operation process illustrated in FIG. 5.

FIG. 5 is a flowchart illustrating an example of a humidity control process of the air conditioning apparatus illustrated in FIG. 2. FIG. 6 is a flowchart illustrating an example of a forced condensation dehumidification operation process illustrated in FIG. 5. In the present embodiment, the air conditioning apparatus is switched from the cooling operation to the forced condensation dehumidification operation by the humidity control process illustrated in FIG. 5.

As illustrated in FIG. 5, first, in step S11, the absolute humidity set value calculation section 204 calculates the target absolute humidity D1 from the set temperature T1 acquired from the indoor temperature set value holding section 203 and the set relative humidity U1 acquired from the indoor relative humidity set value holding section 202 using the absolute humidity translation table illustrated in FIG. 3 for speeding up arithmetic processing.

Next, in step S12, the dew-point temperature calculation section 209 calculates the dew-point temperature TD from the set temperature T1 acquired from the indoor temperature set value holding section 203 and the set relative humidity U1 acquired from the indoor relative humidity set value holding section 202 using the dew-point temperature translation table illustrated in FIG. 4 for speeding up arithmetic processing.

It is assumed that the operation mode determination section 215 determines that the current operation mode is the cooling operation mode on the basis of a comparison result of the indoor and outdoor temperature comparison section 214. In this case, the following cooling operation is performed in steps S13 to S21.

First, in step S13, the operation mode determination section 215 gives an instruction of the cooling operation mode to the indoor unit fan/blow-off port control section 223, and the indoor unit fan/blow-off port control section 223 controls a set position of the blow-off port 225 to an open position to open the blow-off port 225.

Next, in step S14, the indoor unit fan/blow-off port control section 223 controls a set air volume of the indoor unit fan 224 to an ON state to cause the indoor unit fan 224 to start blowing air into the room through the blow-off port 225.

Next, in step S15, the indoor temperature comparison section 210 acquires the indoor temperature T2 from the indoor temperature detection section 206, acquires the set temperature TI from the indoor temperature set value holding section 203, and calculates the set temperature difference Δt1 by subtracting the set temperature T1 from the indoor temperature T2.

Next, in step S16, the heat exchanger temperature comparison and determination section 217 determines whether the set temperature difference Δt1 is equal to or larger than the threshold 1 (e.g., 2° C.). When the heat exchanger temperature comparison and determination section 217 determines that the set temperature difference Δt1 is not equal to or larger than the threshold 1 (NO in step S16), the heat exchanger temperature comparison and determination section 217 turns off the compressor 218 to stop the compressor 218 using the compressor control section 219 in step S18. Then, step S15 and subsequent steps are continued.

On the other hand, when the heat exchanger temperature comparison and determination section 217 determines that the set temperature difference Δt1 is equal to or larger than the threshold 1 (YES in step S16), the heat exchanger temperature comparison and determination section 217 turns on the compressor 218 to actuate the compressor 218 using the compressor control section 219 to cool the indoor heat exchanger 220 at the set temperature HT in step S17.

Next, in step S19, the indoor temperature comparison section 210 acquires the indoor temperature T2 from the indoor temperature detection section 206, acquires the set temperature TI from the indoor temperature set value holding section 203, and calculates the set temperature difference Δt1 by subtracting the set temperature T1 from the indoor temperature T2.

Next, in step S20, the heat exchanger temperature comparison and determination section 217 determines whether the set temperature difference Δt1 is equal to or smaller than the threshold 2 (e.g., 0° C.). When the heat exchanger temperature comparison and determination section 217 determines that the set temperature difference Δt1 is not equal to or smaller than the threshold 2 (NO in step S20), the heat exchanger temperature comparison and determination section 217 shifts the process to step S19. Then, step S19 and subsequent steps are continued.

On the other hand, when the heat exchanger temperature comparison and determination section 217 determines that the set temperature difference Δt1 is equal to or smaller than the threshold 2 (YES in step S20), the heat exchanger temperature comparison and determination section 217 turns off the compressor 218 to stop the compressor 218 using the compressor control section 219 in step S21.

Next, in step S22, the indoor and outdoor temperature comparison section 214 acquires the set temperature T1 from the indoor temperature set value holding section 203, acquires the outdoor temperature T3 from the outdoor temperature detection section 213, and calculates the indoor and outdoor temperature difference Δt2 by subtracting the outdoor temperature T3 from the set temperature T1.

Next, in step S23, the operation mode determination section 215 determines whether the indoor and outdoor temperature difference Δt2 is equal to or larger than the threshold 3 (e.g., 3° C.). When the operation mode determination section 215 determines that the indoor and outdoor temperature difference Δt2 is not equal to or larger than the threshold 3 (NO in step S23), the operation mode determination section 215 determines that the current operation mode is the cooling operation mode and shifts the process to step S15. Then, step S15 and subsequent steps are continued.

On the other hand, when the operation mode determination section 215 determines that the indoor and outdoor temperature difference Δt2 is equal to or larger than the threshold 3 (YES in step S23), the operation mode determination section 215 determines that the current operation mode is the forced condensation dehumidification operation mode and shifts the process to the forced condensation dehumidification operation process illustrated in FIG. 6 in step S24.

As illustrated in FIG. 6, in the forced condensation dehumidification operation process, first, in step S31, the operation mode determination section 215 gives an instruction of the forced condensation dehumidification operation mode to the indoor unit fan/blow-off port control section 223, and the indoor unit fan/blow-off port control section 223 controls the set position of the blow-off port 225 to a closed position to close the blow-off port 225.

Next, in step S32, the indoor unit fan/blow-off port control section 223 turns off the indoor unit fan 224 to stop the indoor unit fan 224 to stop blowing air into the room through the blow-off port 225.

Next, in step S33, the heat exchanger temperature comparison and determination section 217 calculates the heat exchanger temperature difference Δt3 by subtracting the dew-point temperature TD of the indoor heat exchanger 220, the dew-point temperature TD being selected by the heat exchanger set temperature selection section 212, from the heat exchanger temperature T4 detected by the heat exchanger temperature detection section 216.

Next, in step S34, the heat exchanger temperature comparison and determination section 217 determines whether the heat exchanger temperature difference Δt3 is larger than the threshold 4 (e.g., 0° C.). When the heat exchanger temperature comparison and determination section 217 determines that the heat exchanger temperature difference Δt3 is not larger than the threshold 4 (NO in step S34), the heat exchanger temperature comparison and determination section 217 turns off the compressor 218 to stop the compressor 218 using the compressor control section 219 in step S36. Then, step S33 and subsequent steps are continued.

On the other hand, when the heat exchanger temperature comparison and determination section 217 determines that the heat exchanger temperature difference Δt3 is larger than the threshold 4 (YES in step S34), the heat exchanger temperature comparison and determination section 217 turns on the compressor 218 using the compressor control section 219 to cool the indoor heat exchanger 220 at the dew-point temperature TD in step S35.

Next, in step S37, the absolute humidity calculation section 207 calculates the current indoor absolute humidity D2 from the indoor temperature T2 detected by the indoor temperature detection section 206 and the indoor relative humidity U2 detected by the indoor relative humidity detection section 205 using the absolute humidity translation table illustrated in FIG. 3 for speeding up arithmetic processing.

Next, in step S38, the absolute humidity comparison section 208 calculates the absolute humidity difference Δt4 by subtracting the target absolute humidity D1 calculated by the absolute humidity set value calculation section 204 from the current indoor absolute humidity D2 calculated by the absolute humidity calculation section 207.

Next, in step S39, the heat exchanger temperature comparison and determination section 217 determines whether the absolute humidity difference Δt4 is larger than the threshold 5 (e.g., 0 g/m$^3$). When the heat exchanger temperature comparison and determination section 217 determines that the absolute humidity difference Δt4 is larger than the threshold 5 (YES in step S39), the heat exchanger temperature comparison and determination section 217 shifts the process to step S33. Then, step S33 and subsequent steps are continued.

On the other hand, when the heat exchanger temperature comparison and determination section 217 determines that the absolute humidity difference Δt4 is not larger than the threshold 5 (NO in step S39), the heat exchanger temperature comparison and determination section 217 turns off the compressor 218 to stop the compressor 218 using the compressor control section 219 in step S40.

Next, in step S41, the indoor and outdoor temperature comparison section 214 acquires the set temperature T1 from the indoor temperature set value holding section 203, acquires the outdoor temperature T3 from the outdoor temperature detection section 213, and calculates the indoor and outdoor temperature difference Δt2 by subtracting the outdoor temperature T3 from the set temperature T1.

Next, in step S42, the operation mode determination section 215 determines whether the indoor and outdoor temperature difference Δt2 is equal to or smaller than the threshold 6 (e.g., 0° C.). When the operation mode determination section 215 determines that the indoor and outdoor temperature difference Δt2 is equal to or smaller than the threshold 6 (YES in step S42), the operation mode determination section 215 determines that the current operation mode is the cooling operation mode and finishes the forced condensation dehumidification operation in step S44, and then returns the process to step S25 illustrated in FIG. 5.

On the other hand, when the operation mode determination section 215 determines that the indoor and outdoor temperature difference Δt2 is not equal to or smaller than the threshold 6 (NO in step S42), the operation mode determination section 215 determines whether a forced condensation dehumidification operation stopping operation by a user using a remote control (not illustrated) has been performed in step S43. When the operation mode determination section 215 determines that the forced condensation dehumidification operation stopping operation by a user has been performed (YES in step S43), the operation mode determination section 215 determines that the current operation mode is the cooling operation mode and finishes the forced condensation dehumidification operation in step S44, and then returns the process to step S25 illustrated in FIG. 5. On the other hand, when the operation mode determination section 215 determines that the forced condensation dehumidification operation stopping operation by a user has not been performed (NO in step S43), the operation mode determination section 215 shifts the process to step S37. Then, step S37 and subsequent steps are continued.

After the forced condensation dehumidification operation process described above is finished, the operation mode determination section 215 determines whether a cooling operation stopping operation by a user using the remote control (not illustrated) has been performed in step S25 illustrated in FIG. 5. When the operation mode determination section 215 determines that the cooling operation stopping operation by a user has been performed (YES in step S25), the operation mode determination section 215 finishes the cooling operation and finishes the process in step S26. On the other hand, when the operation mode determination section 215 determines that the cooling operation stopping operation by a user has not been performed (NO in step S25), the operation mode determination section 215 shifts the process to step S13. Then, step S13 and subsequent steps are continued.

Figure 7:
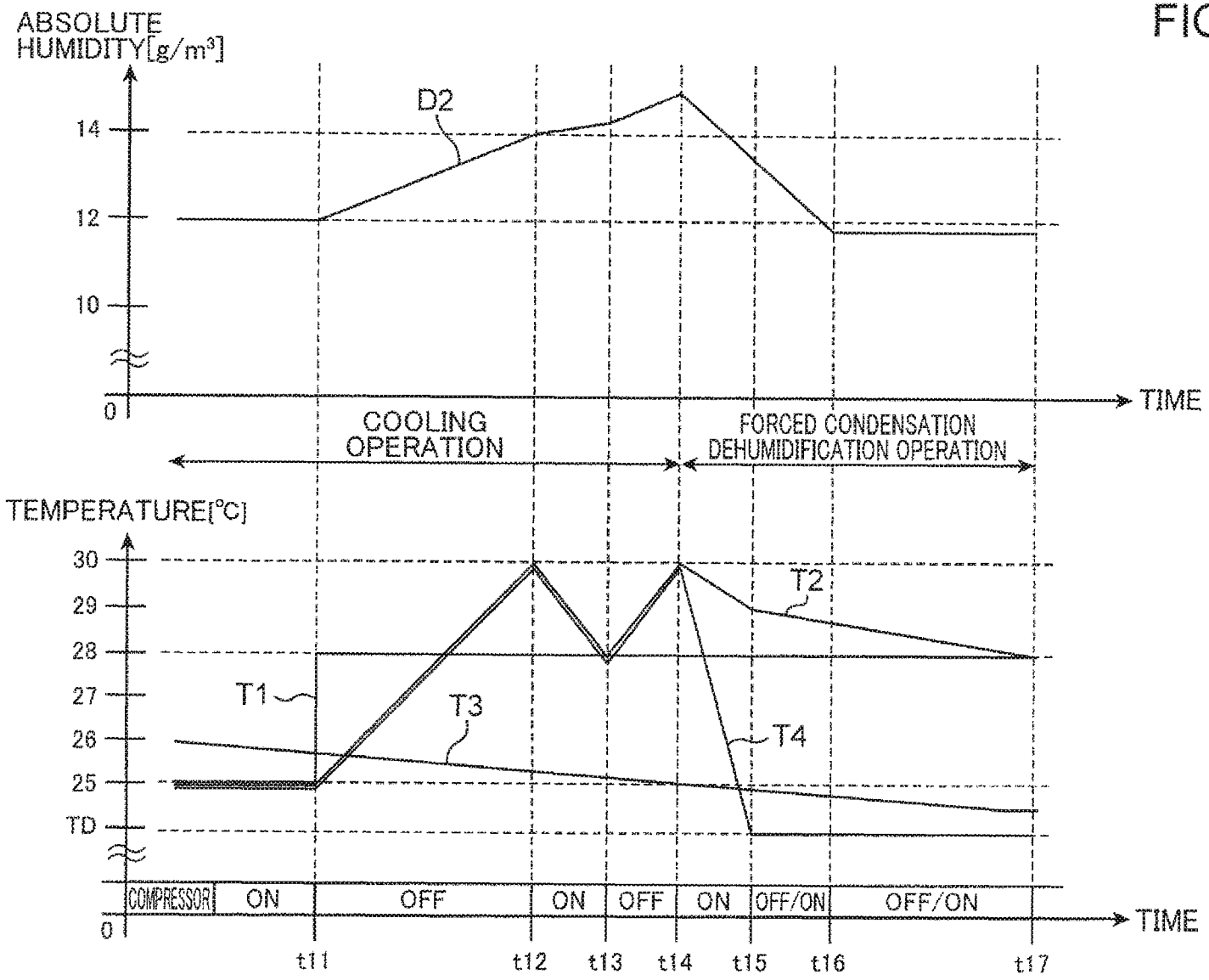
FIG. 7 is a diagram illustrating an example of an operating state of the air conditioning apparatus illustrated in FIG. 2.

FIG. 7 is a diagram illustrating an example of an operating state of the air conditioning apparatus illustrated in FIG. 2. The operating state of FIG. 7 illustrates a case where the set temperature T1 is 28° C., the threshold 1 is 2° C., the threshold 2 is 0° C., the threshold 3 is 3° C., the threshold 4 is 0° C., the threshold 5 is 0 g/m$^3$, and the threshold 6 is 0° C.

As illustrated in FIG. 7, first, the set temperature T1 of the cooling operation is changed from 25° C. to 28° C., and the compressor 218 is turned off at a bedtime t11. Then, the indoor temperature T2 and the heat exchanger temperature T4 rise, and the compressor 218 is in an OFF state until a cooling operation start time t12 at which the indoor temperature T2 becomes 30° C. which is 2° C. higher than the set temperature T1 (28° C.). At this time, the indoor absolute humidity D2 also rises.

Then, the compressor 218 is turned on at the cooling operation start time t12. At this time, the indoor temperature T2 and the heat exchanger temperature T4 drop, and the indoor absolute humidity D2 gradually rises.

Then, when the indoor temperature T2 reaches the set temperature T1 (28° C.) at a cooling operation stop time t13, the compressor 218 is turned off. At this time, the indoor absolute humidity D2 further rises.

The outdoor temperature T3 drops with time. At a forced condensation dehumidification operation start time t14 at which the outdoor temperature T3 becomes 25° C. which is 3° C. lower than the set temperature T1 (28° C.), the cooling operation is switched to the forced condensation dehumidification operation. That is, the compressor 218 is turned on to cool the indoor heat exchanger 220 at the dew-point temperature TD. Thus, the heat exchanger temperature T4 reaches the dew-point temperature TD at a forced condensation dehumidification operation maintenance start time t15. At this time, the indoor absolute humidity D2 drops.

Then, the heat exchanger temperature T4 is maintained at the dew-point temperature TD by repeatedly turning off and on the compressor 218 by the forced condensation dehumidification operation, and the indoor absolute humidity D2 drops to the target absolute humidity D1 (11.8 g/m$^3$) at a target absolute humidity arrival time t16.

Then, the compressor 218 is further repeatedly turned off and on by the forced condensation dehumidification operation, so that the heat exchanger temperature T4 is maintained at the dew-point temperature TD. Thus, the state in which the indoor absolute humidity D2 is the target absolute humidity D1 (11.8 g/m$^3$) is maintained until a rising time t17.

As described above, in the present embodiment, when the difference between the set temperature T1 and the outdoor temperature T3 becomes equal to or larger than the threshold 3, the cooling operation is switched to the forced condensation dehumidification operation, the indoor unit fan 224 is stopped, and the blow-off port 225 is closed, so that an appropriate temperature and an appropriate humidity are both achieved. Accordingly, a user can continue comfortable sleep without nocturnal awakening caused by excessive cooling or high humidity.

The forced condensation dehumidification operation process is not particularly limited to the above example. For example, after the indoor absolute humidity D2 reaches the target absolute humidity D1, the indoor heat exchanger 220 may be cooled so that the heat exchanger temperature T4 falls within a predetermined range including the dew-point temperature TD, for example, a range from the dew-point temperature TD to (the dew-point temperature TD+0.5 to 3° C.).

Figure 8:
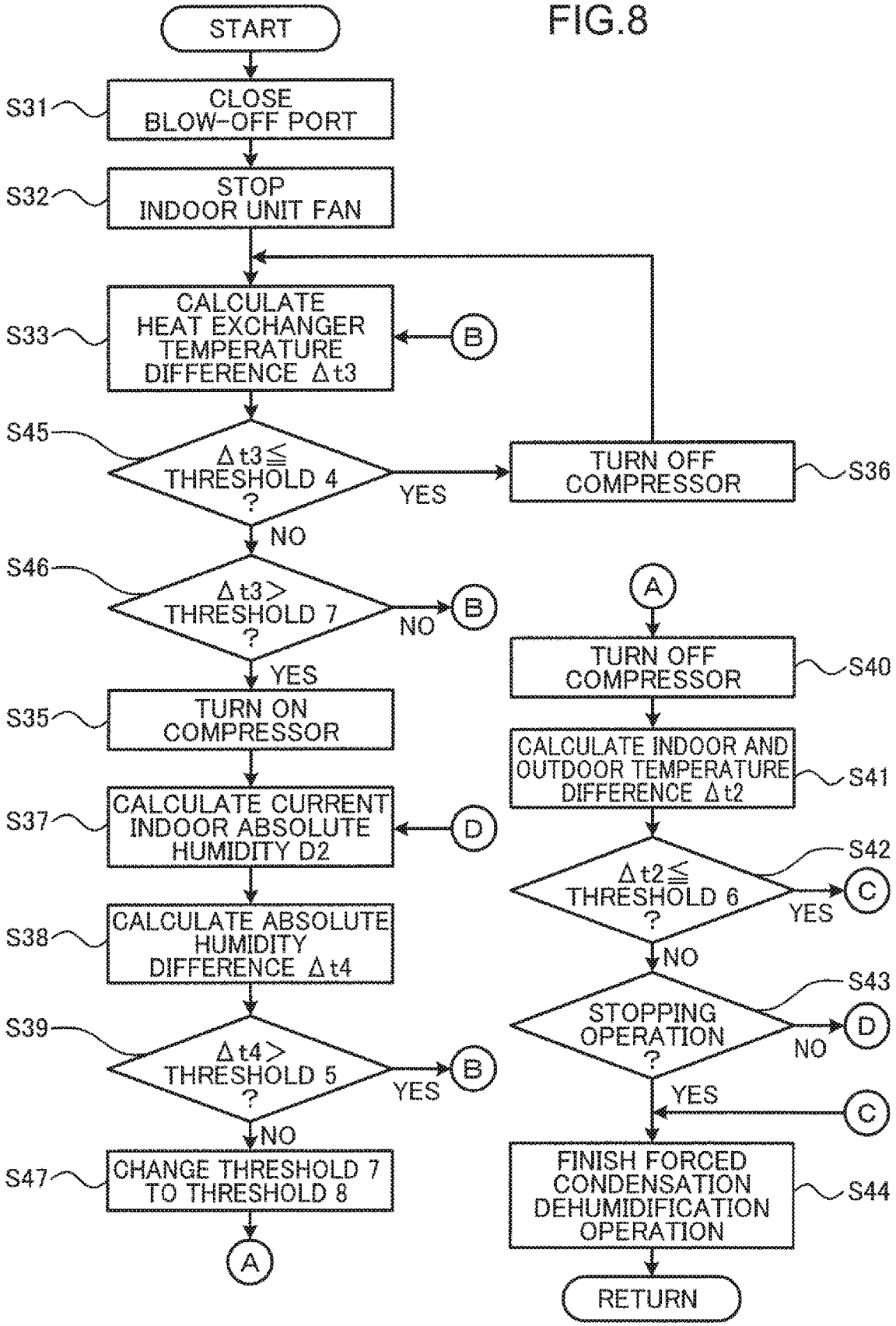
FIG. 8 is a flowchart illustrating another example of the forced condensation dehumidification operation process illustrated in FIG. 5.

FIG. 8 is a flowchart illustrating another example of the forced condensation dehumidification operation process illustrated in FIG. 5. In FIG. 8, processes similar to the processes of FIG. 6 will be designated by the same reference signs as those of FIG. 6, and detailed description thereof will be omitted.

First, processes similar to steps S31 to S33 illustrated in FIG. 6 are executed in steps S31 to S33. Then, in step S45, the heat exchanger temperature comparison and determination section 217 determines whether the heat exchanger temperature difference Δt3 is equal to or smaller than the threshold 4 (e.g., 0° C.). When the heat exchanger temperature comparison and determination section 217 determines that the heat exchanger temperature difference Δt3 is equal to or smaller than the threshold 4 (YES in step S45), the heat exchanger temperature comparison and determination section 217 turns off the compressor 218 to stop the compressor 218 using the compressor control section 219 in step S36. Then, step S33 and subsequent steps are continued.

On the other hand, when the heat exchanger temperature comparison and determination section 217 determines that the heat exchanger temperature difference Δt3 is not equal to or smaller than the threshold 4 (NO in step S45), the heat exchanger temperature comparison and determination section 217 determines whether the heat exchanger temperature difference Δt3 is larger than a predetermined threshold 7 (e.g., 0° C.). When the heat exchanger temperature comparison and determination section 217 determines that the heat exchanger temperature difference Δt3 is not larger than the threshold 7 (NO in step S46), the heat exchanger temperature comparison and determination section 217 shifts the process to step S33. Then, step S33 and subsequent steps are continued.

On the other hand, when the heat exchanger temperature comparison and determination section 217 determines that the heat exchanger temperature difference Δt3 is larger than the threshold 7 (YES in step S46), the heat exchanger temperature comparison and determination section 217 turns on the compressor 218 using the compressor control section 219 to cool the indoor heat exchanger 220 at the dew-point temperature TD in step S35.

As described above, the process similar to the forced condensation dehumidification operation process illustrated in FIG. 6 is executed by using the same value as the threshold 4 as the threshold 7, and the temperature of the indoor heat exchanger 220, that is, the heat exchanger temperature T4 is maintained at the dew-point temperature TD after dropping to the dew-point temperature TD.

Next, processes similar to steps S37 to S39 illustrated in FIG. 6 are executed in steps S37 to S39. When the heat exchanger temperature comparison and determination section 217 determines that the absolute humidity difference Δt4 is larger than the threshold 5 (e.g., 0 g/m$^3$) in step S39 (YES in step S39), the heat exchanger temperature comparison and determination section 217 shifts the process to step S33. Then, step S33 and subsequent steps are continued.

On the other hand, when the heat exchanger temperature comparison and determination section 217 determines that the absolute humidity difference Δt4 is not larger than the threshold 5 (e.g., 0 g/m$^3$) in step S39 (NO in step S39), the heat exchanger temperature comparison and determination section 217 changes the threshold 7 to a threshold 8 (e.g., 0.5° C.) which is larger than the threshold 7 in step S47. Then, processes similar to steps S40 to S44 illustrated in FIG. 6 are executed in steps S40 to S44.

Thus, after the indoor absolute humidity D2 drops to the target absolute humidity D1, when the heat exchanger temperature comparison and determination section 217 determines that the heat exchanger temperature difference Δt3 is not equal to or smaller than the threshold 4 (NO in step S45), the heat exchanger temperature comparison and determination section 217 determines whether the heat exchanger temperature difference Δt3 is larger than the threshold 8 in step S46. When the heat exchanger temperature comparison and determination section 217 determines that the heat exchanger temperature difference Δt3 is not larger than the threshold 8 (NO in step S46), the heat exchanger temperature comparison and determination section 217 shifts the process to step S33. Then, subsequent steps are continued.

On the other hand, when the heat exchanger temperature comparison and determination section 217 determines that the heat exchanger temperature difference Δt3 is larger than the threshold 8 (YES in step $46), the heat exchanger temperature comparison and determination section 217 turns on the compressor 218 using the compressor control section 219 to cool the indoor heat exchanger 220 at the dew-point temperature TD in step S35.

As described above, the temperature of the indoor heat exchanger 220, that is, the heat exchanger temperature T4 is maintained within the range from the dew-point temperature TD to (the dew-point temperature TD+0.5° C.) by changing the threshold 7 to the threshold 8 when the indoor absolute humidity D2 drops to the target absolute humidity D1.

Figure 9:
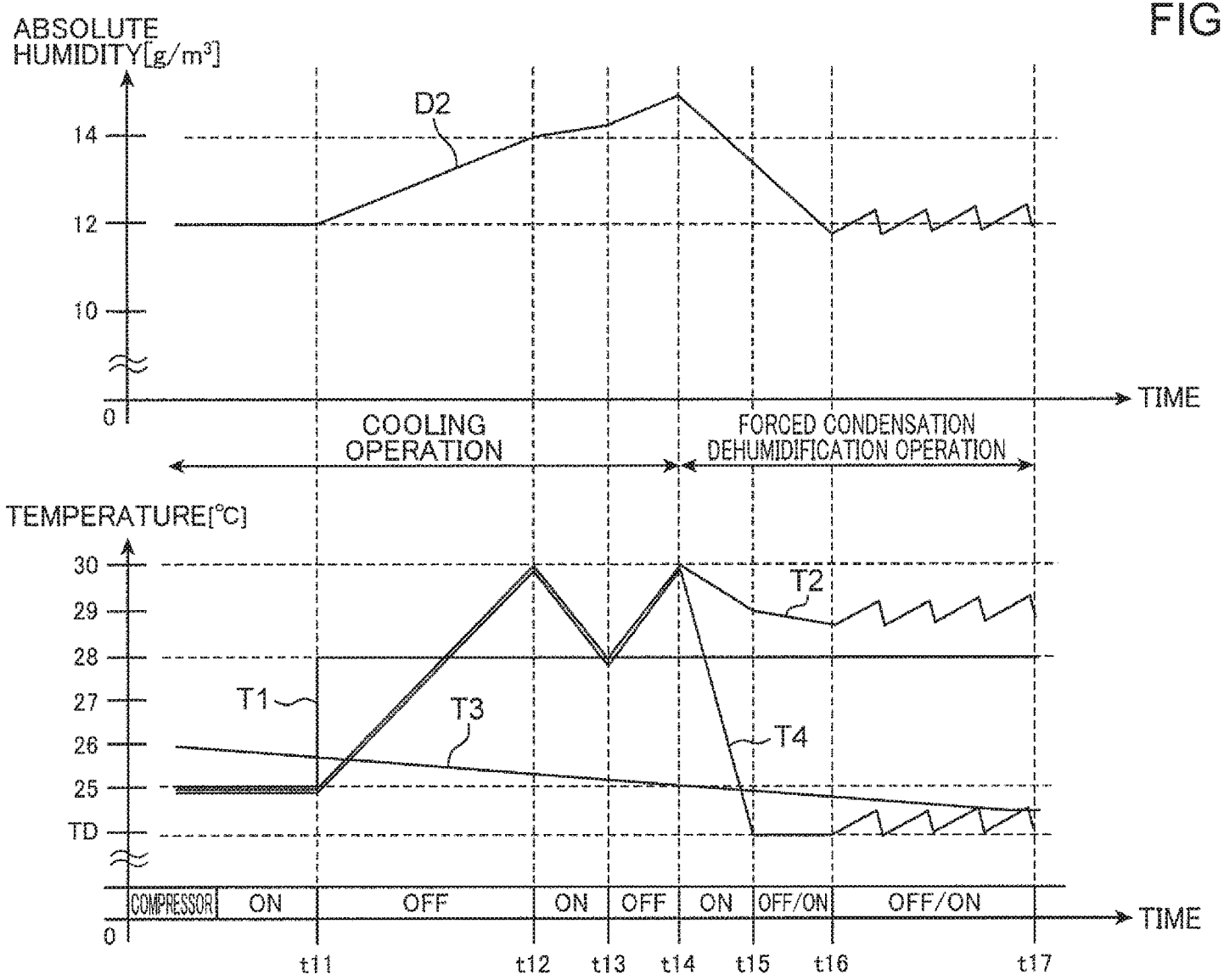
FIG. 9 is a diagram illustrating an example of an operating state of the air conditioning apparatus when the forced condensation dehumidification operation process illustrated in FIG. 8 is executed.

FIG. 9 is a diagram illustrating an example of an operating state of the air conditioning apparatus when the forced condensation dehumidification operation process illustrated in FIG. 8 is executed. The operating state of FIG. 9 illustrates a case where the set temperature T1 is 28° C., the threshold 1 is 2° C., the threshold 2 is 0° C., the threshold 3 is 3° C., the threshold 4 is 0° C., the threshold 5 is 0 g/m$^3$, the threshold 6 is 0° C., the threshold 7 is 0° C., and the threshold 8 is 0.5° C.

As illustrated in FIG. 9, the operating state of the air conditioning apparatus from a bedtime t11 to a target absolute humidity arrival time t16 in the cooling operation is similar to that of FIG. 7. Then, when the indoor absolute humidity D2 drops to the target absolute humidity D1 (11.8 g/m$^3$) at the target absolute humidity arrival time t16, the compressor 218 repeats an operation in which the compressor 218 is turned off when the heat exchanger temperature T4 becomes the dew-point temperature TD and turned on when the heat exchanger temperature T4 becomes (the dew-point temperature TD+0.5° C.). Thus, the heat exchanger temperature T4 is maintained within the range from the dew-point temperature TD to (the dew-point temperature TD+0.5° C.). As a result, the indoor temperature T2 is maintained within an appropriate temperature range around 29° C., and the indoor absolute humidity D2 is maintained within an appropriate humidity range (11.8 to 12.2 g/m$^3$) including the target absolute humidity D1 (11.8 g/m$^3$) until a rising time t17.

The forced condensation dehumidification operation process described above cools the indoor heat exchanger 220 so that the indoor absolute humidity D2 falls within the predetermined range including the target absolute humidity D after the indoor absolute humidity D2 reaches the target absolute humidity D in the forced condensation dehumidification operation. Thus, it is possible to bring the inside of the room into a state with an appropriate temperature and an appropriate humidity while preventing the temperature inside the room from becoming too low.

Second Embodiment

In the first embodiment, the cooling operation is switched to the forced condensation dehumidification operation according to the difference between the set temperature T1 or the indoor temperature T2 and the outdoor temperature T3. On the other hand, in the present embodiment, the cooling operation is switched to the forced condensation dehumidification operation according to the difference between an operating time and a stopped time of the cooling operation, the operating time and the stopped time being adjacent to each other in the time series.

Figure 10:
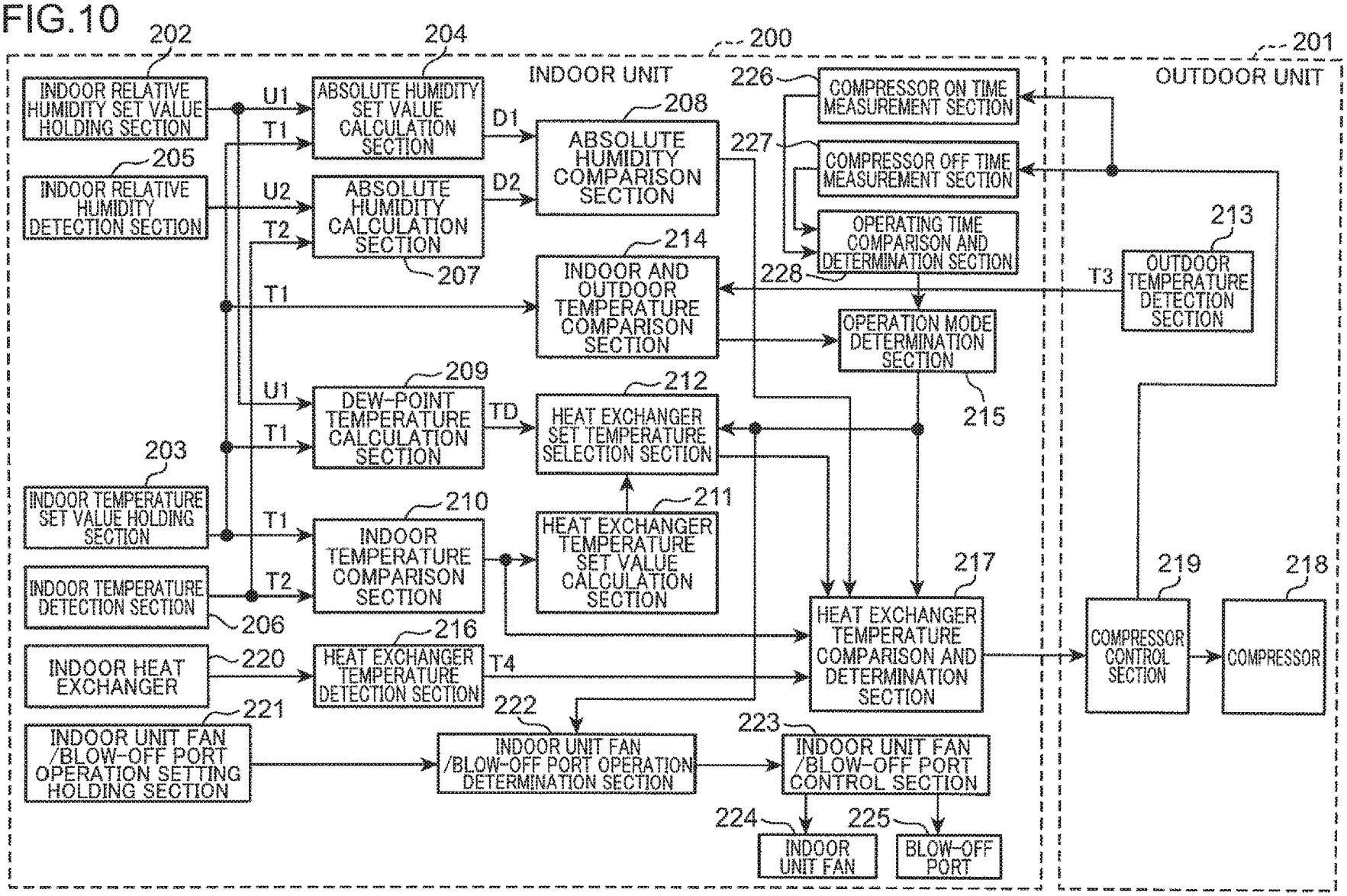
FIG. 10 is a block diagram illustrating an example of the configuration of an air conditioning apparatus in a second embodiment of the present disclosure.

FIG. 10 is a block diagram illustrating an example of the configuration of an air conditioning apparatus in the second embodiment of the present disclosure. The air conditioning apparatus illustrated in FIG. 10 differs from the air conditioning apparatus illustrated in FIG. 2 in that a compressor ON time measurement section 226, a compressor OFF time measurement section 227, and the operating time comparison and determination section 228 are additionally provided. Identical reference signs designate similar parts between FIG. 2 and FIG. 10, and detailed description thereof will be omitted.

The compressor ON time measurement section 226 acquires an operating state of a compressor 218 in the cooling operation from a compressor control section 219, and measures an ON time which indicates a cooling time of an indoor heat exchanger 220, that is, a time during which the compressor 218 is in an ON state in the cooling operation as an example of the operating time of the cooling operation.

The compressor OFF time measurement section 227 acquires an operating state of the compressor 218 in the cooling operation from the compressor control section 219, and measures an OFF time which indicates a non-cooling time of the indoor heat exchanger 220, that is, a time during which the compressor 218 is in an OFF state in the cooling operation as an example of the stopped time of the cooling operation.

The operating time comparison and determination section 228 compares the ON time acquired from the compressor ON time measurement section 226 with the OFF time acquired from the compressor OFF time measurement section 227, and obtains a time difference d1 (=OFF time−ON time) between the ON time and the OFF time which are adjacent to each other in the time series.

An operation mode determination section 215 determines switching from the cooling operation to the forced condensation dehumidification operation according to the time difference d1 between the ON time and the OFF time, the time difference d1 being acquired from the operating time comparison and determination section 228. Specifically, the operation mode determination section 215 determines switching from the cooling operation to the forced condensation dehumidification operation when the time difference d1 between the ON time and the OFF time becomes equal to or larger than a threshold 9 (e.g., 35 minutes).

The threshold 9 is not particularly limited to the above example, and various values can be used as the threshold 9. Further, the operating time and the stopped time of the cooling operation are not particularly limited to the above example, and various changes can be made. For example, a count value of a counter which counts up for each predetermined unit time may be used as the operating time and the stopped time of the cooling operation.

A heat exchanger temperature comparison and determination section 217 and an indoor unit fan/blow-off port control section 223 control the cooling operation which causes an indoor unit fan 224 to blow air, opens an blow-off port 225, and cools an indoor heat exchanger 220 so that an indoor temperature T2 becomes a set temperature T1. The heat exchanger temperature comparison and determination section 217 and the indoor unit fan/blow-off port control section 223 control the forced condensation dehumidification operation which stops the indoor unit fan 224, closes the blow-off port 225, and dehumidifies the inside of the room by cooling the indoor heat exchanger 220 at a dew-point temperature TD. Further, the heat exchanger temperature comparison and determination section 217 and the indoor unit fan/blow-off port control section 223 switch the cooling operation to the forced condensation dehumidification operation according to a result of the determination of the switching by the operation mode determination section 215.

The operation of the forced condensation dehumidification operation is not particularly limited to the above example. For example, the indoor unit fan 224 may be caused to blow air or the blow-off port 225 may be opened in the forced condensation dehumidification operation. Further, a known dehumidification operation may be used instead of the forced condensation dehumidification operation. For example, the reheating dry operation disclosed in JP 2001-280668 A may be used.

In the present embodiment, an absolute humidity set value calculation section 204 is an example of the first acquisition section or the first calculation section, a dew-point temperature calculation section 209 is an example of the second acquisition section or the second calculation section, an absolute humidity calculation section 207 is an example of the third acquisition section or the third calculation section, and the heat exchanger temperature comparison and determination section 217 and the indoor unit fan/blow-off port control section 223 are examples of the control section. Further, an outdoor temperature detection section 213 is an example of the fourth acquisition section.

Further, an indoor temperature set value holding section 203 is an example of another first acquisition section, an indoor temperature detection section 206 is an example of another second acquisition section, the operation mode determination section 215 is an example of another determination section, and the heat exchanger temperature comparison and determination section 217 and the indoor unit fan/blow-off port control section 223 are examples of another control section. Further, an indoor relative humidity set value holding section 202 is an example of another third acquisition section, an indoor relative humidity detection section 205 is an example of another fourth acquisition section, the absolute humidity set value calculation section 204 is an example of another first calculation section, the dew-point temperature calculation section 209 is an example of another second calculation section, and the absolute humidity calculation section 207 is an example of another third calculation section.

Each of the indoor relative humidity set value holding section 202, the indoor temperature set value holding section 203, the absolute humidity set value calculation section 204, the absolute humidity calculation section 207, the dew-point temperature calculation section 209, the operation mode determination section 215, the heat exchanger temperature comparison and determination section 217, and the indoor unit fan/blow-off port control section 223 includes, for example, a processor or a memory. In the present embodiment, the absolute humidity set value calculation section 204, the absolute humidity calculation section 207, the dew-point temperature calculation section 209, the operation mode determination section 215, the heat exchanger temperature comparison and determination section 217, and the indoor unit fan/blow-off port control section 223 are incorporated in an indoor unit 200. However, the present invention is not particularly limited to this example, and various changes can be made. For example, some or all of these sections may be incorporated in an outdoor unit 201 or incorporated in an external server.

Figure 11:
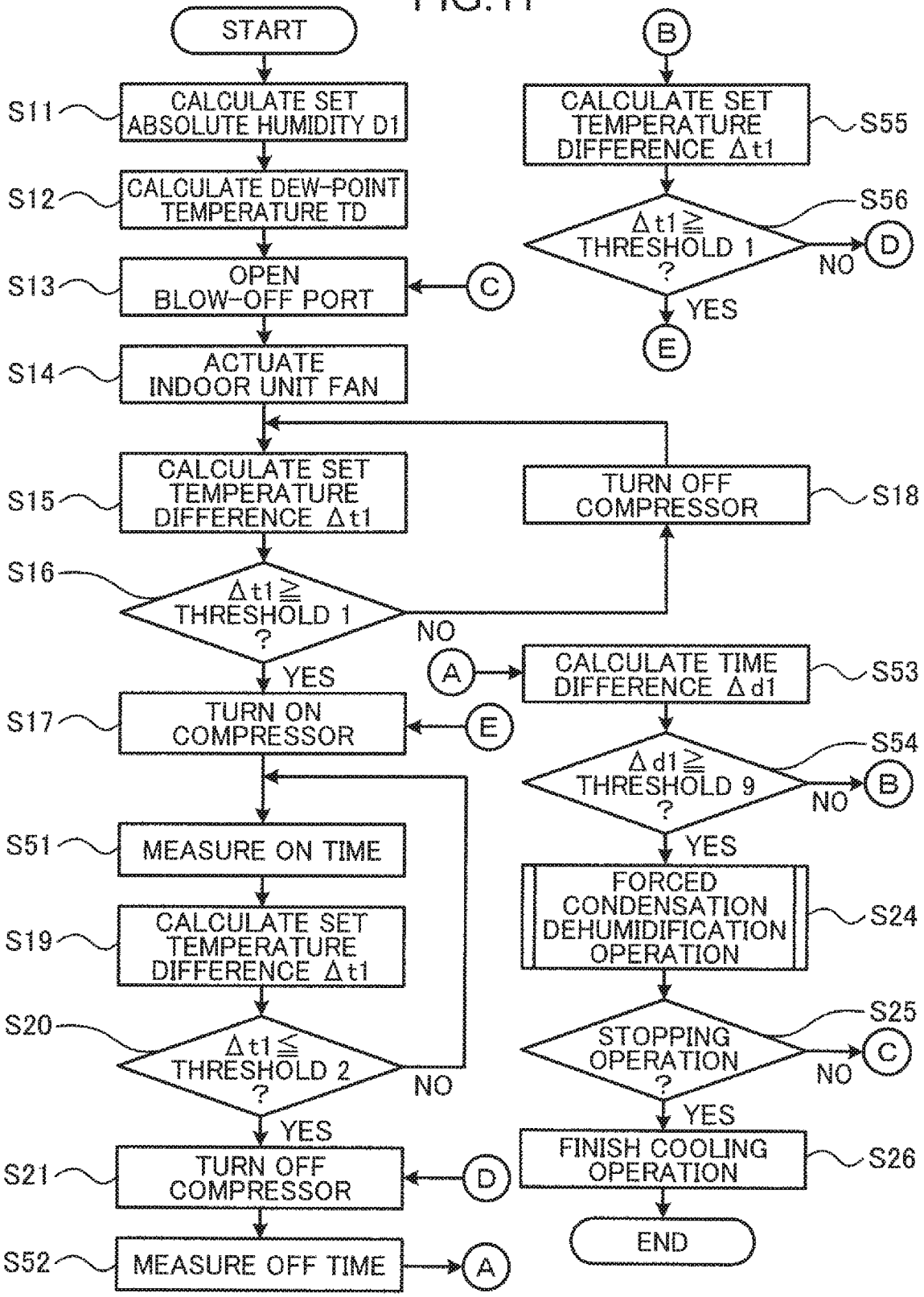
FIG. 11 is a flowchart illustrating an example of a humidity control process of the air conditioning apparatus illustrated in FIG. 10.

FIG. 11 is a flowchart illustrating an example of a humidity control process of the air conditioning apparatus illustrated in FIG. 10. In the present embodiment, the air conditioning apparatus is switched from the cooling operation to the forced condensation dehumidification operation by the humidity control process illustrated in FIG. 11.

As illustrated in FIG. 11, first, processes similar to steps S11 to S18 illustrated in FIG. 5 are executed in steps S11 to Sig. Then, in step S51, the compressor ON time measurement section 226 acquires the operating state of the compressor 218 in the cooling operation from the compressor control section 219, and measures the ON time of the compressor 218 in the cooling operation.

Next, processes similar to steps S19 to S21 illustrated in FIG. 5 are executed in steps S19 to S21. Then, in step S52, the compressor OFF time measurement section 227 acquires the operating state of the compressor 218 in the cooling operation from the compressor control section 219, and measures the OFF time of the compressor 218 in the cooling operation.

Next, in step S53, the operating time comparison and determination section 228 calculates the time difference d1 by subtracting the ON time measured by the compressor ON time measurement section 226 from the OFF time measured by the compressor OFF time measurement section 227.

Next, in step S54, the operation mode determination section 215 determines whether the time difference d1 is equal to or larger than the threshold 9 (e.g., 35 minutes). When it is determined that the time difference d1 is not equal to or larger than the threshold 9 in step S54 (NO in step S54), an indoor temperature comparison section 210 acquires an indoor temperature T2 from the indoor temperature detection section 206, acquires a set temperature T1 from the indoor temperature set value holding section 203, and calculates a set temperature difference Δt1 by subtracting the set temperature T1 from the indoor temperature T2 in step S55.

Next, in step S56, the heat exchanger temperature comparison and determination section 217 determines whether the set temperature difference Δt1 is equal to or larger than a threshold 1 (e.g., 2° C.). When the heat exchanger temperature comparison and determination section 217 determines that the set temperature difference Δt1 is not equal to or larger than the threshold 1 (NO in step S56), the heat exchanger temperature comparison and determination section 217 shifts the process to step S21 to maintain an OFF state of the compressor 218. Next, in step S52, the compressor OFF time measurement section 227 measures the OFF time of the compressor 218 in the cooling operation. Then, step S53 and subsequent steps are continued.

On the other hand, when the heat exchanger temperature comparison and determination section 217 determines that the set temperature difference Δt1 is equal to or larger than the threshold 1 (YES in step S56), the heat exchanger temperature comparison and determination section 217 turns on the compressor 218 to actuate the compressor 218 using the compressor control section 219 to cool the indoor heat exchanger 220 at the set temperature HT in step S17. Next, in step S51, the compressor ON time measurement section 226 measures the ON time of the compressor 218 in the cooling operation. Then, step S19 and subsequent steps are continued.

On the other hand, when it is determined that the time difference Δt1 is equal to or larger than the threshold 9 in step S54 (YES in step S54), the forced condensation dehumidification operation process illustrated in FIG. 8 is executed in step S24 in a manner similar to the first embodiment. Then, in steps S25 and S26, processes similar to steps S25 and S26 illustrated in FIG. 5 are executed, and the process is finished. The forced condensation dehumidification operation process executed in step S24 is not particularly limited to the above example, and various changes can be made. For example, the forced condensation dehumidification operation process illustrated in FIG. 6 may be executed in step S24.

Figure 12:
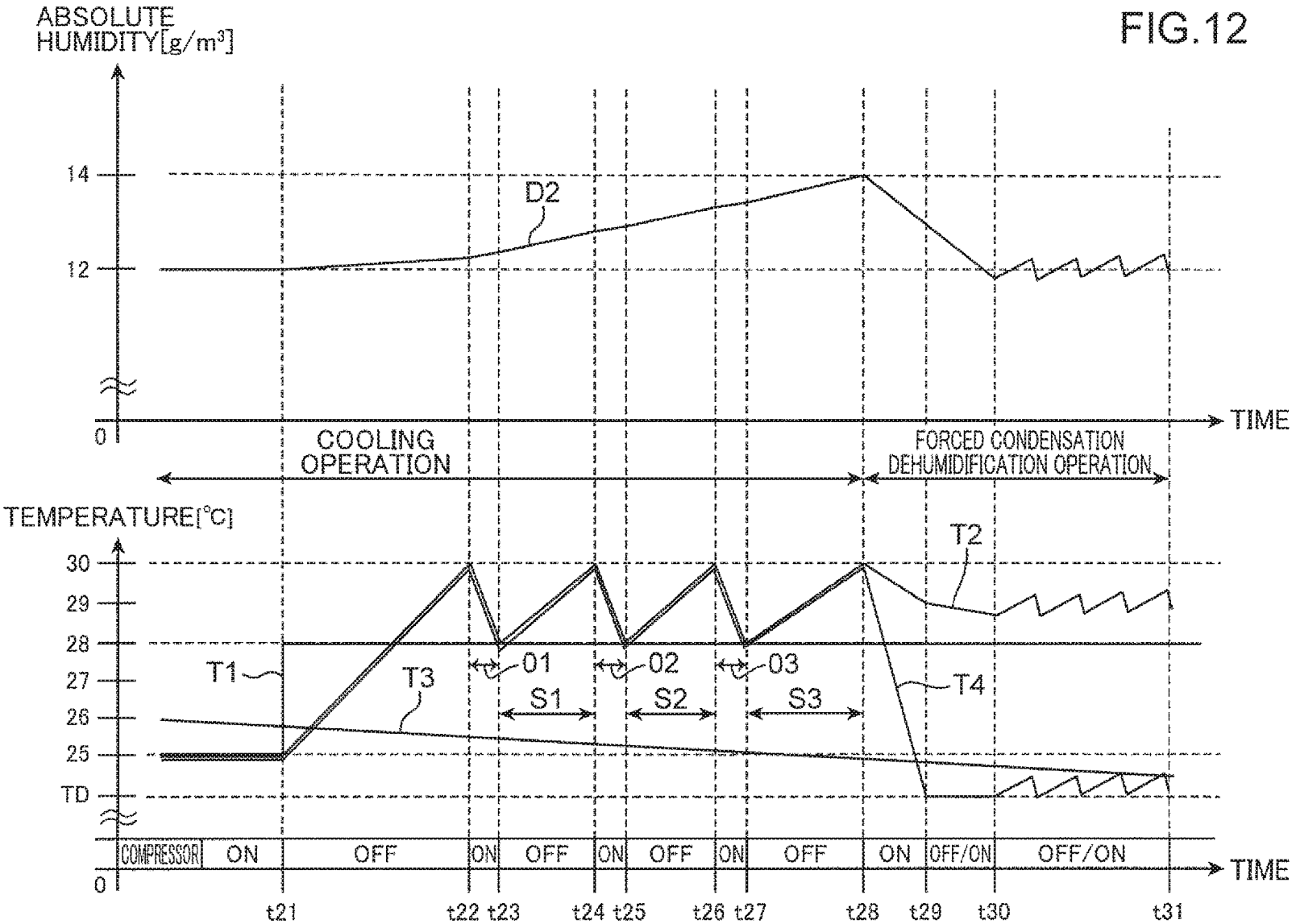
FIG. 12 is a diagram illustrating an example of an operating state of the air conditioning apparatus illustrated in FIG. 10.

FIG. 12 is a diagram illustrating an example of an operating state of the air conditioning apparatus illustrated in FIG. 10. The operating state of FIG. 12 illustrates a case where the forced condensation dehumidification operation process illustrated in FIG. 8 is executed, and the set temperature T1 is 28° C., the threshold 1 is 2° C., a threshold 2 is 0° C., a threshold 4 is 0° C., a threshold 5 is 0 g/m$^3$, a threshold 6 is 0° C., a threshold 7 is 0° C., a threshold 8 is 0.5° C., and the threshold 9 is 35 minutes.

As illustrated in FIG. 12, first, the set temperature T1 of the cooling operation is changed from 25° C. to 28° C., and the compressor 218 is turned off at a bedtime t21. At this time, the indoor temperature T2 and a heat exchanger temperature T4 rise, and the compressor 218 is in an OFF state until a cooling operation start time t22 at which the indoor temperature T2 becomes 30° C. which is 2° C. higher than the set temperature T1 (28° C.). At this time, an indoor absolute humidity D2 also rises.

Then, when the indoor temperature T2 becomes 30° C. which is 2° C. higher than the set temperature T1 (28° C.), the compressor 218 is turned on at the cooling operation start time t22, and an ON time O1 of the compressor 218 is measured. At this time, the indoor temperature T2 and the heat exchanger temperature T4 drop, and the indoor absolute humidity D2 gradually rises.

Then, when the indoor temperature T2 becomes the set temperature T1 (28° C.), the compressor 218 is turned off at a cooling operation stop time t23, and an OFF time SI of the compressor 218 is measured. At this time, the indoor temperature T2 and the heat exchanger temperature T4 rise, and the indoor absolute humidity D2 further rises.

When the ON time O1 is 13 minutes, and the OFF time S1 is 42 minutes, the time difference d1 (=S1−O1) between the ON time and the OFF time is 29 minutes which is not equal to or larger than the threshold 9 (35 minutes). Thus, the cooling operation is not switched to the forced condensation dehumidification operation, but maintained.

Then, when the indoor temperature T2 becomes 30° C. which is 2° C. higher than the set temperature T1 (28° C.), the compressor 218 is turned on at a cooling operation start time t24, and an ON time O2 of the compressor 218 is measured. At this time, the indoor temperature T2 and the heat exchanger temperature T4 drop, and the indoor absolute humidity D2 gradually rises.

Then, when the indoor temperature T2 becomes the set temperature T1 (28° C.), the compressor 218 is turned off at a cooling operation stop time t25, and an OFF time S2 of the compressor 218 is measured. At this time, the indoor temperature T2 and the heat exchanger temperature T4 rise, and the indoor absolute humidity D2 further rises.

When the ON time O2 is 12 minutes, and the OFF time S2 is 45 minutes, the time difference d1 (=S2−O2) between the ON time and the OFF time is 33 minutes which is not equal to or larger than the threshold 9 (35 minutes). Thus, the cooling operation is not switched to the forced condensation dehumidification operation, but maintained.

Then, when the indoor temperature T2 becomes 30° C. which is 2° C. higher than the set temperature T1 (28° C.), the compressor 218 is turned on at a cooling operation start time t26, and an ON time O3 of the compressor 218 is measured. At this time, the indoor temperature T2 and the heat exchanger temperature T4 drop, and the indoor absolute humidity D2 gradually rises.

Then, when the indoor temperature T2 becomes the set temperature T1 (28° C.), the compressor 218 is turned off at a cooling operation stop time t27, and an OFF time S3 of the compressor 218 is measured. At this time, the indoor temperature T2 and the heat exchanger temperature T4 rise, and the indoor absolute humidity D2 further rises.

When the outdoor temperature T3 drops with time, the ON time O3 is 11 minutes, and the OFF time S3 is 48 minutes, the time difference d1 (=S3−O3) between the ON time and the OFF time is 37 minutes, that is, becomes equal to or larger than the threshold 9 (35 minutes). Thus, the cooling operation is switched to the forced condensation dehumidification operation at a forced condensation dehumidification operation start time t28. That is, the compressor 218 is turned on to cool the indoor heat exchanger 220 at the dew-point temperature TD. Thus, the heat exchanger temperature T4 reaches the dew-point temperature TD at a forced condensation dehumidification operation maintenance start time t29. At this time, the indoor absolute humidity D2 also drops.

Then, the heat exchanger temperature T4 is maintained at the dew-point temperature TD by repeatedly turning off and on the compressor 218 by the forced condensation dehumidification operation, and the indoor absolute humidity D2 drops to a target absolute humidity D1 (11.8 g/m$^3$) at a target absolute humidity arrival time 130.

Then, when the indoor absolute humidity D2 drops to the target absolute humidity D1 (11.8 g/m$^3$) at the target absolute humidity arrival time t30, the compressor 218 repeats an operation in which the compressor 218 is turned off when the heat exchanger temperature T4 becomes the dew-point temperature TD and turned on when the heat exchanger temperature T4 becomes (the dew-point temperature TD+0.5° C.). Thus, the heat exchanger temperature T4 is maintained within the range from the dew-point temperature TD to (the dew-point temperature TD+0.5° C.). As a result, the indoor temperature T2 is maintained within an appropriate temperature range around 29° C., and the indoor absolute humidity D2 is maintained within an appropriate humidity range (11.8 to 12.2 g/m) including the target absolute humidity D1 (11.8 g/m$^3$) until a rising time t31.

As described above, in the present embodiment, when the time difference d between the ON time and the OFF time which are adjacent to each other in the time series becomes equal to or larger than the threshold 9, the cooling operation is switched to the forced condensation dehumidification operation, the indoor unit fan 224 is stopped, and the blow-off port 225 is closed, so that an appropriate temperature and an appropriate humidity are both achieved. Accordingly, a user can continue comfortable sleep without nocturnal awakening caused by excessive cooling or high humidity.

Further, the forced condensation dehumidification operation process described above cools the indoor heat exchanger 220 so that the indoor absolute humidity D2 falls within the predetermined range including the target absolute humidity D1 after the indoor absolute humidity D2 reaches the target absolute humidity D1 in the forced condensation dehumidification operation. Thus, it is possible to bring the inside of the room into a state with an appropriate temperature and an appropriate humidity while preventing the temperature inside the room from becoming too low.

The air conditioning apparatus and the air conditioning control method according to one aspect of the present disclosure enable a person who is sensitive to cold to continue comfortable sleep without nocturnal awakening caused by excessive cooling or high humidity even when the set temperature in the cooling operation is set rather high by the person in air conditioning control at summer night. Thus, the air conditioning apparatus and the air conditioning control method according to one aspect of the present disclosure are useful as an air conditioning apparatus and an air conditioning control method that maintain a preferred absolute humidity in a bedroom where a person is sleeping even with rather high temperature setting in the cooling operation in the air conditioning control at summer night.

This application is based on Japanese Patent application Nos. 2018-052331 and 2018-052332 filed in Japan Patent Office on Mar. 20, 2018 and Japanese Patent application No. 2018-209779 filed in Japan Patent Office on Nov. 7, 2018 the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. An air conditioning apparatus comprising:

a first acquisition section that acquires a first absolute humidity indicating a target absolute humidity determined from a first temperature indicating a previously set temperature and a first relative humidity indicating a previously set relative humidity;

a second acquisition section that acquires a dew-point temperature determined from the first temperature and the first relative humidity;

a third acquisition section that acquires a second absolute humidity indicating an absolute humidity inside a room, the absolute humidity being determined from a second temperature indicating a temperature inside the room and a second relative humidity indicating a relative humidity inside the room;

a heat exchanger that exchanges heat between air inside the room and a refrigerant;

an air blower that blows air cooled by the heat exchanger;

an air outlet for blowing air blown by the air blower into the room; and a control section that determines whether the difference between the second temperature and an outside temperature is greater than a threshold, switches the air conditioning apparatus from a cooling operation mode to a dehumidification operation mode that stops air-blowing of the air blower, and closes the air outlet in response to the determination that the difference between the second temperature and the outside temperature becomes greater than the predetermined threshold, determines whether the second absolute humidity is higher than the first absolute humidity, determines whether the difference between the acquired dew-point temperature and the temperature of the heat exchanger is greater than a second predetermined threshold, and cools the heat exchanger so that the temperature of the heat exchanger becomes equal to the acquired dew-point temperature in the dehumidification operation mode in response to the determination that the second absolute humidity is higher than the first absolute humidity and the determination that the difference between the acquired dew-point temperature and the temperature of the heat exchanger is greater than a second predetermined threshold.

2. The air conditioning apparatus according to claim 1, wherein the first acquisition section includes a first calculation section that acquires the first temperature and the first relative humidity and calculates the first absolute humidity from the first temperature and the first relative humidity, the second acquisition section includes a second calculation section that acquires the first temperature and the first relative humidity and calculates the dew-point temperature from the first temperature and the first relative humidity, and the third acquisition section includes a third calculation section that acquires the second temperature and the second relative humidity and calculates the second absolute humidity from the second temperature and the second relative humidity.

3. The air conditioning apparatus according to claim 1, wherein the control section continues cooling of the heat exchanger while the second absolute humidity is higher than the first absolute humidity.

4. The air conditioning apparatus according to claim 1, wherein the control section continues cooling of the heat exchanger while a temperature of the heat exchanger is not lower than the dew-point temperature.

5. The air conditioning apparatus according to claim 1, further comprising a fourth acquisition section that acquires a third temperature indicating a temperature outside the room, wherein the control section starts the dehumidification operation when the first temperature or the second temperature is higher than the third temperature.

6. The air conditioning apparatus according to claim 1, wherein the control section cools the heat exchanger so that a temperature of the heat exchanger falls within a predetermined range including the dew-point temperature after the second absolute humidity reaches the first absolute humidity in the dehumidification operation.

7. The air conditioning apparatus according to claim 1, further comprising a first memory configured to store an absolute humidity translation table listing a plurality of values for absolute humidity, relative humidity, and temperature and associating each value of absolute humidity with specific values for relative humidity and temperature, wherein the first acquisition section acquires from the absolute humidity translation table stored in the first memory the first absolute humidity indicating the target absolute humidity determined from the first temperature stored in the absolute humidity translation table in the first memory indicating the previously set temperature and the first relative humidity stored in the absolute humidity translation table in the first memory indicating the previously set relative humidity, and the third acquisition section acquires from the absolute humidity translation table in the first memory the second absolute humidity indicating the absolute humidity inside the room, the absolute humidity being determined from the second temperature stored in the absolute humidity translation table in the first memory indicating the temperature inside the room and the second relative humidity stored in the absolute humidity translation table in the first memory indicating the relative humidity inside the room.

8. The air conditioning apparatus according to claim 1, further comprising a second memory configured to store a dew-point temperature translation table listing a plurality of values for the dew-point temperature, the room temperature, and relative humidity, and associating each value of the dew-point temperature with specific values for relative humidity and room temperature, wherein the second acquisition section acquires from the dew-point temperature translation table stored in the second memory the dew-point temperature determined from the first temperature and the first relative humidity.

9. An air conditioning control method for controlling an air conditioning apparatus using a processor, the air conditioning apparatus including a heat exchanger that exchanges heat between air inside a room and a refrigerant, an air blower that blows air cooled by the heat exchanger, and an air outlet for blowing air blown by the air blower into the room, the air conditioning control method comprising:

acquiring a first absolute humidity indicating a target absolute humidity determined from a first temperature indicating a previously set temperature and a first relative humidity indicating a previously set relative humidity;

acquiring a dew-point temperature determined from the first temperature and the first relative humidity;

acquiring a second absolute humidity indicating an absolute humidity inside the room, the absolute humidity being determined from a second temperature indicating a temperature inside the room and a second relative humidity indicating a relative humidity inside the room;

determining whether the difference between the second temperature and an outside temperature is greater than a threshold, switching the air conditioning apparatus from a cooling operation mode to a dehumidification operation mode that stops air-blowing of the air blower, and closes the air outlet in response to the determination that the difference between the second temperature and the outside temperature becomes greater than the predetermined threshold, determining whether the second absolute humidity is higher than the first absolute humidity, determining whether the difference between the acquired dew-point temperature and the temperature of the heat exchanger is greater than a second predetermined threshold, and cooling the heat exchanger so that the temperature of the heat exchanger becomes equal to the acquired dew-point temperature in the dehumidification operation mode in response to the determination that the second absolute humidity is higher than the first absolute humidity and the determination that the difference between the acquired dew-point temperature and the temperature of the heat exchanger is greater than a second predetermined threshold.

10. The air conditioning control method according to claim 9, wherein the air conditioning apparatus further comprises a first memory configured to store an absolute humidity translation table listing a plurality of values for absolute humidity, relative humidity, and temperature and associating each value of absolute humidity with specific values for relative humidity and temperature, wherein the acquiring of the first absolute humidity acquires from the absolute humidity translation table stored in the first memory the first absolute humidity indicating the target absolute humidity determined from the first temperature stored in the absolute humidity translation table in the first memory indicating the previously set temperature and the first relative humidity stored in the absolute humidity translation table in the first memory indicating the previously set relative humidity, and the acquiring of the second absolute humidity acquires from the absolute humidity translation table in the first memory the second absolute humidity indicating the absolute humidity inside the room, the absolute humidity being determined from the second temperature stored in the absolute humidity translation table in the first memory indicating the temperature inside the room and the second relative humidity stored in the absolute humidity translation table in the first memory indicating the relative humidity inside the room.

11. The air conditioning control method according to claim 9, wherein the air conditioning apparatus further includes a second memory configured to store a dew-point temperature translation table listing a plurality of values for the dew-point temperature, the room temperature, and relative humidity, and associating each value of the dew-point temperature with specific values for relative humidity and room temperature, wherein the dew-point temperature acquiring acquires from the dew-point temperature translation table stored in the second memory the dew-point temperature determined from the first temperature and the first relative humidity.

* * * * *